US008090294B2

(12) United States Patent
Tanda et al.

(10) Patent No.: US 8,090,294 B2
(45) Date of Patent: Jan. 3, 2012

(54) IMAGE FORMING APPARATUS WITH STRUCTURE FOR SUPPRESSING RISING OF DEVELOPER AGITATING ROLLER AT START OF ROTATION

(75) Inventors: Tetsuo Tanda, Osaka (JP); Hiroaki Ohashi, Osaka (JP)

(73) Assignee: Kyocera Mita Corporation (JP)

( * ) Notice: Subject to any disclaimer, the term of this patent is extended or adjusted under 35 U.S.C. 154(b) by 395 days.

(21) Appl. No.: 12/475,731

(22) Filed: Jun. 1, 2009

(65) Prior Publication Data

US 2009/0297220 A1 Dec. 3, 2009

(30) Foreign Application Priority Data

May 30, 2008 (JP) ..... 2008-143491

(51) Int. Cl.
*G03G 15/04* (2006.01)

(52) U.S. Cl. ..... 399/119; 399/110; 399/111; 399/262

(58) Field of Classification Search ..... 399/110, 399/111, 119, 262, 167
See application file for complete search history.

(56) References Cited

U.S. PATENT DOCUMENTS 6,708,011 B2 * 3/2004 Nomura et al. ..... 399/110
6,763,209 B2 * 7/2004 Higeta et al. ..... 399/109
7,561,827 B2 * 7/2009 Shiraki et al. ..... 399/119
7,715,755 B2 * 5/2010 Shiraki ..... 399/111
2004/0022556 A1 2/2004 Nomura
2004/0165910 A1 * 8/2004 Sato et al. ..... 399/116
2005/0244187 A1 * 11/2005 Saito et al. ..... 399/111
2005/0254854 A1 * 11/2005 Deguchi ..... 399/111
2006/0140673 A1 * 6/2006 Kamimura et al. ..... 399/119
2006/0140674 A1 * 6/2006 Sato ..... 399/119
2007/0077086 A1 * 4/2007 Takakuwa et al. ..... 399/111
2007/0217816 A1 * 9/2007 Shiraki ..... 399/111

FOREIGN PATENT DOCUMENTS

JP 10-55110 2/1998

* cited by examiner

*Primary Examiner* — David Gray
*Assistant Examiner* — G. M. Hyder
(74) *Attorney, Agent, or Firm* — Gerald E. Hespos; Michael J. Porco

(57) ABSTRACT

An image forming apparatus includes an image bearing body and a developer apparatus with mutually opposing first and second side faces to supply a developer to the image bearing body. The developer apparatus is installed removably on a frame with first and second wall surfaces opposing the first and second side faces respectively. First and second fulcrum sections project respectively on the first and second side faces. First and second installation grooves are provided respectively on the first and second wall surfaces and have open upper ends that receive the first and second fulcrum sections respectively. First and second supporting structures support the first fulcrum and second fulcrum sections that are fit respectively into the first and second installation grooves.

16 Claims, 15 Drawing Sheets

IMAGE FORMING APPARATUS WITH STRUCTURE FOR SUPPRESSING RISING OF DEVELOPER AGITATING ROLLER AT START OF ROTATION

BACKGROUND OF THE INVENTION

1. Field of the Invention

The present invention relates to an image forming apparatus comprising a developer apparatus which supplies developer to an image bearing body.

2. Description of the Related Art

An image forming apparatus forms a toner image that follows an electrostatic latent image on a photosensitive drum, on the circumferential surface of the photosensitive drum, by supplying a developer from a developing roller to the circumferential surface of the photosensitive drum. In the image forming apparatus disclosed in Japanese Patent Application Laid-open No. H10-55110, a developer apparatus rocks about a rocking shaft, and the posture thereof is thus changed between a developing posture in which a developing roller abuts against an image bearing body, such as a photosensitive drum, and a non-developing posture in which the developing roller is separated from the photosensitive drum. This change in the posture of the developer apparatus is carried out by driving a drive mechanism. In development processing for forming a toner image on the circumferential surface of a photosensitive drum, the posture of the developer apparatus is set to the developing posture by driving the drive mechanism. On the other hand, when not bearing out a development process, the posture of the developer apparatus is changed to the non-developing posture by reverse driving of the drive mechanism.

In an image forming apparatus of this kind, an installation structure is employed for installing and removing the developer apparatus to and from a predetermined frame, from above. Generally, this installation structure comprises a pair of U-shaped grooves which are formed respectively in mutually opposing fashion on opposite side faces of the frame, and fulcrum shafts provided respectively on the frame body of the developer apparatus so as to correspond to the U-shaped grooves. By fitting the fulcrum shafts down into the U-shaped grooves via the upper openings, the developer apparatus is installed at a predetermined position on the frame.

In the installation structure described above, when the developing roller or the agitating roller starts to rotate in a state where the posture of the developer apparatus is set to the developing posture, then in response to this rotation, the fulcrum shafts which have been fitted into the U-shaped grooves may be caused to rise upwards. If the developing roller rises up in this way, then a deviation occurs in the positional relationship between the circumferential surface of the developing roller and the circumferential surface of the photosensitive drum. As a result, the supply of toner from the developing roller to the photosensitive drum is not carried out properly, and this leads to a problem in that image defects occur.

SUMMARY OF THE INVENTION

The object of the present invention is to provide an image forming apparatus whereby rising up of the developer apparatus at the start of driving can be suppressed.

The image forming apparatus relating to one aspect of the present invention which achieves this object is an image forming apparatus comprising: an image bearing body; a developer apparatus which has a mutually opposing first side face and second side face, and supplies a developer to the image bearing body; a frame which has a first wall surface opposing the first side face and a second wall surface opposing the second side face, and on which the developer apparatus is removably installed; a first fulcrum section and a second fulcrum section provided so as to project respectively on the first side face and the second side face; a first installation groove and a second installation groove which are provided respectively on the first wall surface and the second wall surface, the upper ends of which are open and into which the first fulcrum section and the second fulcrum section are respectively fitted; and a first supporting structure section and a second supporting structure section which support the first fulcrum section and the second fulcrum section that are fitted respectively into the first installation groove and the second installation groove.

DETAILED DESCRIPTION OF THE PREFERRED EMBODIMENTS

First Embodiment

Figure 1:
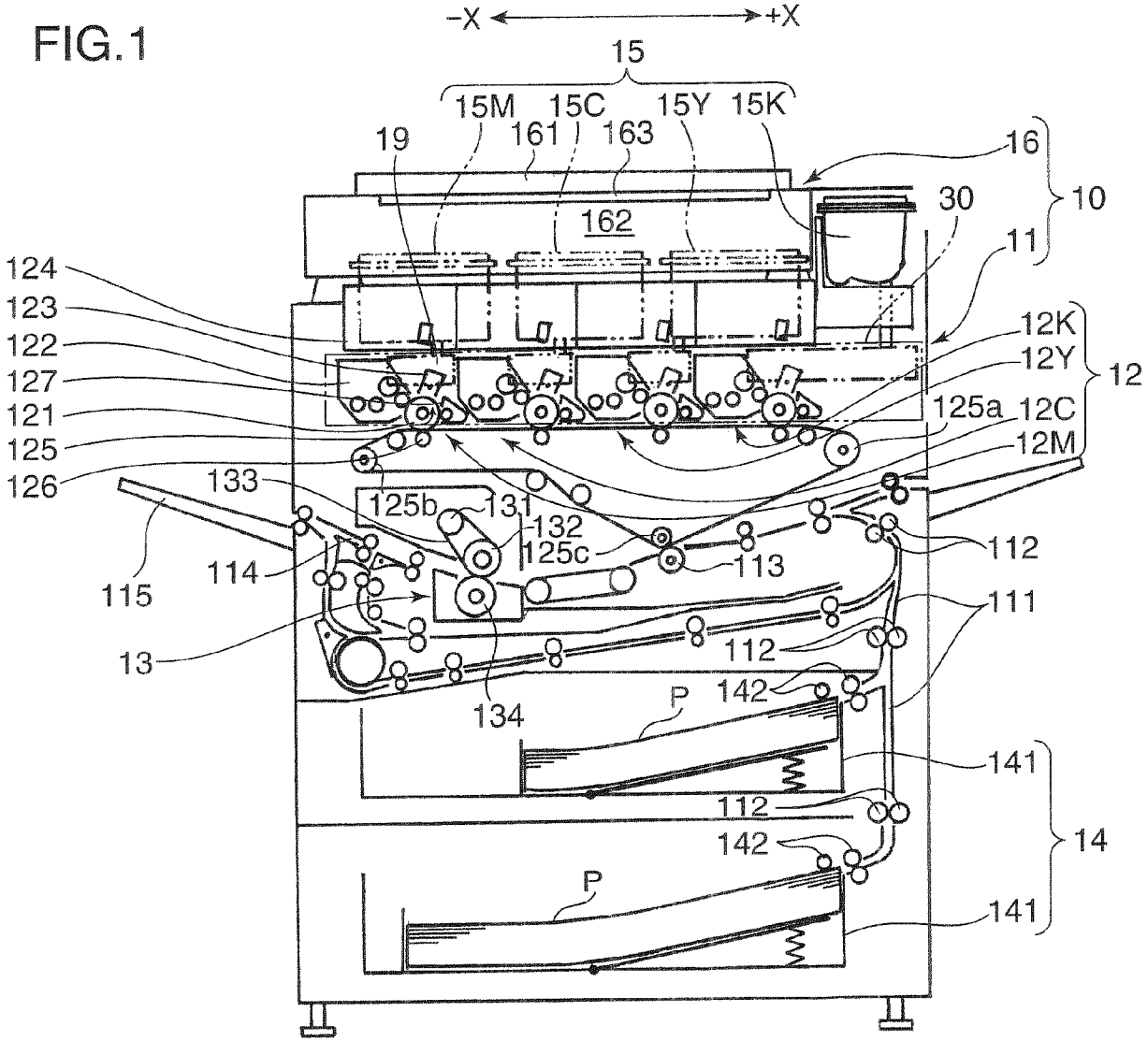
FIG. 1 is a front side cross-sectional diagram showing an image forming apparatus relating to a first embodiment of the present invention.
Figure 2:
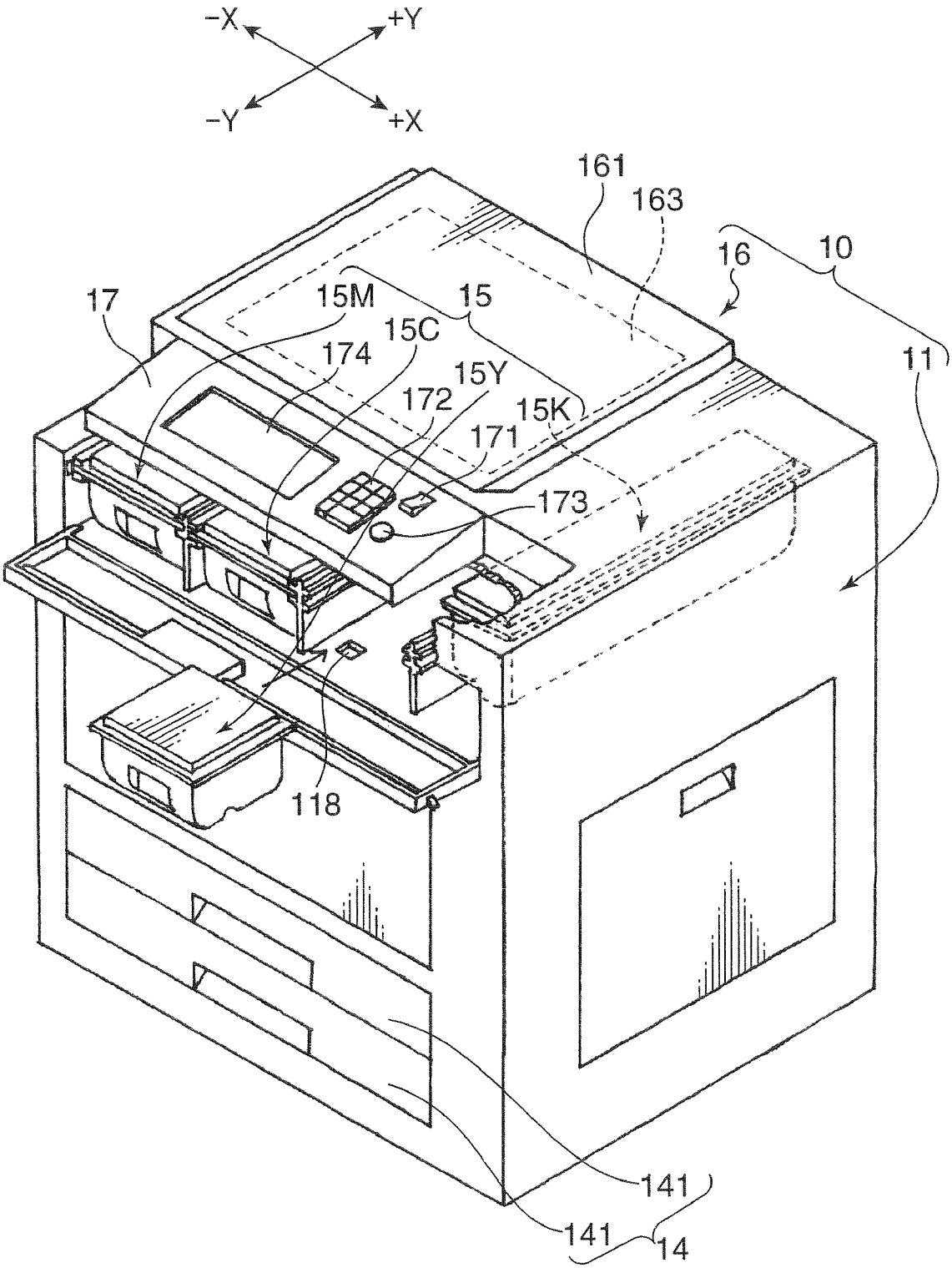
FIG. 2 is an external perspective diagram of the image forming apparatus.

Firstly, an overview of the image forming apparatus relating to an embodiment of the present invention will be described. FIG. 1 is an explanatory diagram showing a front side cross-sectional view for the purpose of describing the internal structure of the image forming apparatus 10, and FIG. 2 is a perspective diagram showing an external view of same. The X-X direction in FIG. 1 and FIG. 2 indicates the left/right direction, and the Y-Y direction indicates the forward/rearward direction. In particular, the −X direction is the leftward direction, the +X direction is the rightward direction, the −Y direction is the forward direction and the +Y direction is the rearward direction.

As shown in FIG. 1, the image forming apparatus 10 is used as a copying machine for color printing, and comprises, as a basic composition, an apparatus main body 11 having a box shape and an image reading unit 16 which reads in an original image, provided above this apparatus main body 11.

An image forming unit 12 which forms an image on the basis of original image information read out by the image reading unit 16, a fixing unit 13 which carries out a fixing process on an image that has been formed by the image forming unit 12 and transferred to paper P, and a paper storage unit 14 which stores paper for transfer, are provided inside the apparatus main body 11.

The image reading unit 16 comprises an original cover 161 provided openably and closably on the upper surface of the apparatus main body 11, and an optical unit 162 disposed so as to oppose the original cover 161 via a contact glass 163 inside a frame on the upper side of the apparatus main body 11. The dimensions of the contact glass 163 are set to planar shape which is slightly smaller than the original cover 161, in order to read in the surface of the original placed thereon. The original cover 161 is opened and closed by forward and reverse rotation about supporting shafts provided on one side edge of the upper surface of the frame body of the image reading unit 16.

An operating panel 17 (see FIG. 2) for inputting processing conditions relating to original image reading and copying processes, and the like, is provided in a suitable position on the image reading unit 16. As shown in FIG. 2, this operating panel 17 comprises a power switch 171 and a keypad 172, as well as start buttons 173, a LCD (liquid crystal display) 174, and mode changing keys, and the like, which are not illustrated.

The optical unit 162 has a light source, a plurality of mirrors, a lens unit, and a CCD (charge coupled device), and the like, which are not illustrated. The light emitted from the light source is reflected by the surface of the original and this reflected light is input to the CCD as original information via the mirror and the lens unit. The original information in the form of an analog signal output from the CCD is converted into a digital signal and stored in a predetermined storage apparatus.

The image forming unit 12 forms a toner image on paper supplied from the paper storage unit 14, and in the present embodiment, a magenta unit 12M, a cyan unit 12C, a yellow unit 12Y and a black unit 12K are disposed successively from the upstream side (the left-hand side of the drawing in FIG. 1) toward the downstream side in the image forming unit 12.

These units 12M, 12C, 12Y and 12K each respectively comprise a photosensitive drum (image bearing body) 121 and a developer apparatus 122. Each of the photosensitive drums 121 receives a supply of toner from the respectively corresponding developer apparatus 122 while rotating in the counter-clockwise direction in FIG. 1. Toner is respectively replenished to each of the developer apparatuses 122 via intermediate hoppers 19 from toner containers 15 which are disposed so as to correspond respectively to the developer apparatuses 122 on the front side (the front surface of drawing in FIG. 1) of the apparatus main body 11, and the right-hand side of the apparatus main body 11 in FIG. 1.

Figure 5:
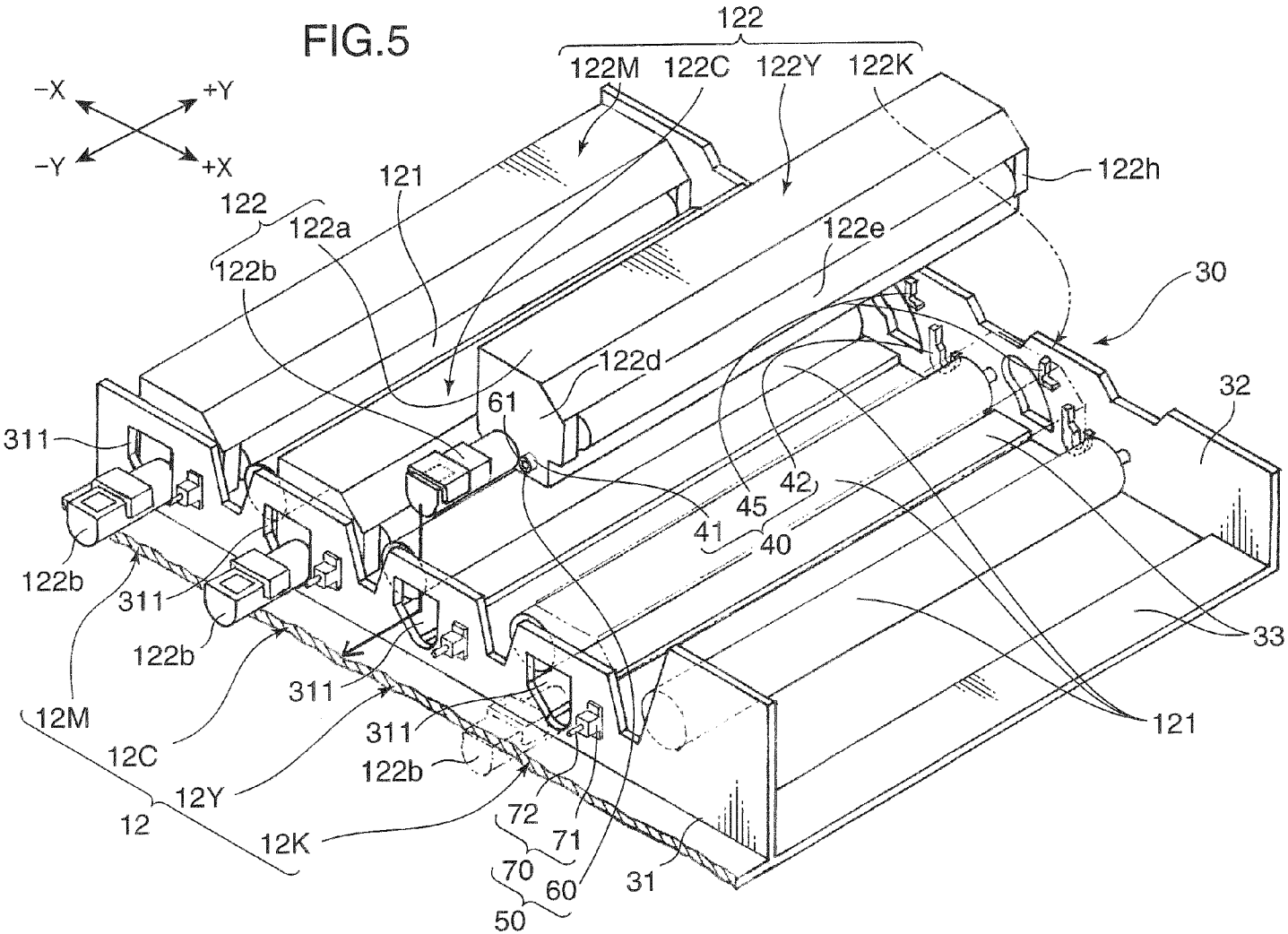
FIG. 5 is a perspective diagram showing a developer apparatus and an image forming frame relating to a first embodiment.

In the present embodiment, the toner containers 15 for replenishing the toners of respective colors (magenta toner container 15M, cyan toner container 15C and yellow toner container 15Y) to the respective developer apparatuses 122 of the magenta, cyan and yellow units 12M, 12C, 12Y (namely, a magenta developer apparatus 122M, a cyan developer apparatus 122C and a yellow developer apparatus 122Y; see FIG. 5), are provided removably with respect to the apparatus main body 11 at a position in front of the optical unit 162 in the front surface upper corner portion of the apparatus main body 11.

On the other hand, the toner container 15 (black toner container 15K) for supplying black toner to the developer apparatus 122 of the black unit 12K (the black developer apparatus 122K; see FIG. 5) has a long dimension in the front/rear direction and is set to have a greater capacity than the other containers. This black toner container 15K is provided detachably with respect to the apparatus main body 11, in the upper portion of the apparatus main body 11 in an empty space to the right-hand side of the optical unit 162.

The intermediate hoppers 19 which are interposed between the toner containers 15 and the developer apparatuses 122 are four in number: an intermediate hopper 19M for magenta toner which corresponds to the magenta developer apparatus 122M, an intermediate hopper 19C for cyan toner which corresponds to the cyan developer apparatus 122C, an intermediate hopper 19Y for yellow toner which corresponds to the yellow developer apparatus 122Y, and an intermediate hopper 19K for back toner which corresponds to the black developer apparatus 122K.

As shown in FIG. 1, the arrangement pitch of the intermediate hoppers 19M, 19C, 19Y and 19K in terms of the positions of the replenishment ports for replenishing toner to the developer apparatuses 122 is set to be the same as the arrangement pitch of the developer apparatuses 122M, 122C, 122Y and 122K. In the intermediate hoppers 19M, 19C and 19Y for magenta toner, cyan toner and yellow toner, the dimensions are set to be the same. On the other hand, the intermediate hopper 19K for black toner is set to have a long dimension in the left/right direction so as to correspond to the black toner container 15K which is installed in the upper right-hand end portion of the apparatus main body 11.

A toner inlet port 191 (FIG. 3) is provided in each intermediate hopper 19 in a right-side position in the ceiling plate of the hopper 19. On the other hand, connecting openings 118 are provided respectively at positions corresponding to the toner inlet ports 191, in the base plate of the installation space where the toner containers 15 are installed. The toner is supplied to the developer apparatus 122 via the connection openings 118.

A charging device 123 is provided respectively at a position directly above each photosensitive drum 121 (the magenta drum, cyan drum, yellow drum and black drum). An exposure apparatus 124 is provided in a position above the charging device 123 and the developer apparatus 122. The circumferential surface of each photosensitive drum 121 is charged uniformly by the charging device 123, and laser light corresponding to the respective color and based on the image data input by the image reading unit 16 is irradiated from the respective exposure apparatus 124 onto the charged circumferential surface of the photosensitive drum 121. By this means, electrostatic latent images are formed respectively on the circumferential surfaces of the magenta, cyan, yellow and black drums 121. By supplying toners of respective colors from the developer apparatuses 122 onto the electrostatic latent images, toner images are formed respectively on the circumferential surfaces of the photosensitive drums 121.

A transfer belt 125 is provided in a position below the photosensitive drums 121 so as to abut against the circumferential surfaces of the respective photosensitive drums 121. The transfer belt 125 is provided tautly about a drive roller 125*a*, an idle roller 125*b* and a secondary transfer opposing roller 125*c*, as well as other rollers that may be necessary. The transfer belt 125 revolves between the drive roller 125*a* and the idle roller 125*b* in synchronism with the photosensitive drums 121, in a state of being pressed against the circumferential surfaces of the photosensitive drums 121 by primary transfer rollers 126 which are provided so as to correspond to each photosensitive drum 121.

Due to the revolution of the transfer belt 125, a magenta toner image is transferred onto the surface of the transfer belt 125 by the photosensitive drum 121 of the magenta unit 12M, whereupon a cyan toner image is transferred onto the same position on the transfer belt 125 by the photosensitive drum 121 of the cyan unit 12C, in a superimposed fashion, whereupon a yellow toner image is transferred onto the same position on the transfer belt 125 by the photosensitive drum 121 of the yellow unit 12Y, in a superimposed fashion, and finally a black toner image is transferred by the photosensitive drum 121 of the black unit 12K, in a superimposed fashion. By this means, a color toner image is formed on the surface of the transfer belt 125. The color toner image formed on the surface of the transfer belt 125 is transferred to paper P that has been conveyed from the paper storage unit 14.

A cleaning apparatus 127 which removes residual toner and thereby cleans the circumferential surfaces of the photosensitive drum 121 is provided respectively at a position to the left of each photosensitive drum 121 in FIG. 1. The circumferential surface of the photosensitive drum 121 that has been cleaned by the corresponding cleaning apparatus 127 subsequently faces the charging device 123 in order to undergo a new charging process. The waste toner that has been removed from the circumferential surface of the photosensitive drum 121 by the cleaning apparatus 127 is recovered into a toner recovery bottle (not illustrated) via a predetermined path.

A paper conveyance path 111 is formed from a position to the right-hand side of the paper storage unit 14 until a position below the image forming unit 12. Pairs of conveyance rollers 112 are provided at suitable positions in this paper conveyance path 111, and paper in the paper storage unit 14 is conveyed toward a position below the transfer belt 125 by driving the pairs of conveyance rollers 112. A secondary transfer roller 113 which abuts against the surface of the transfer belt 125 is provided in the paper conveyance path 111 at a position opposing the secondary transfer opposing roller 125*c*. The toner image on the transfer belt 125 is transferred to paper P which has been conveyed along the paper conveyance path 111, by means of the paper P being pressed and sandwiched between the transfer belt 125 and the secondary transfer roller 113.

The fixing unit 13 carries out a fixing process with respect to the toner image on the paper that has been transferred by the image forming unit 12. The fixing unit 13 comprises a heating roller 131 inside which is provided an electrical heating body, such as a halogen lamp, that forms a heat source, a fixing roller 132 disposed so as to oppose the heating roller 131, a fixing belt 133 provided tautly about the fixing roller 132 and the heating roller 131, and a pressure roller 134 provided so as to oppose the fixing belt 133 via the fixing roller 132.

The paper P bearing a color image which has completed the fixing process is passed along a paper discharge path 114 that extends from above the fixing unit 13 and is discharged to a paper discharge tray 115 provided in the left-hand side wall of the apparatus main body 11.

The paper storage unit 14 has a paper tray 141 for storing a stack of paper P, which is installed detachably at a position below the exposure apparatus 124 in the apparatus main body 11. In the examples shown in FIG. 1 and FIG. 2, the paper tray 141 is provided in two stages, but it may also be provided in three or more stages, or in one stage.

The paper P is picked up one by one from the paper stack accommodated in the paper tray 141, by the driving of the pick-up roller 142. The paper P thus picked up is supplied via the paper conveyance path 111 to the nip section between the secondary transfer roller 113 and the transfer belt 125 in the image forming unit 12, and the color toner image formed on the surface of the transfer belt 125 is transferred to the paper P. The movement of the paper P after the transfer process is as described above.

Figure 3:
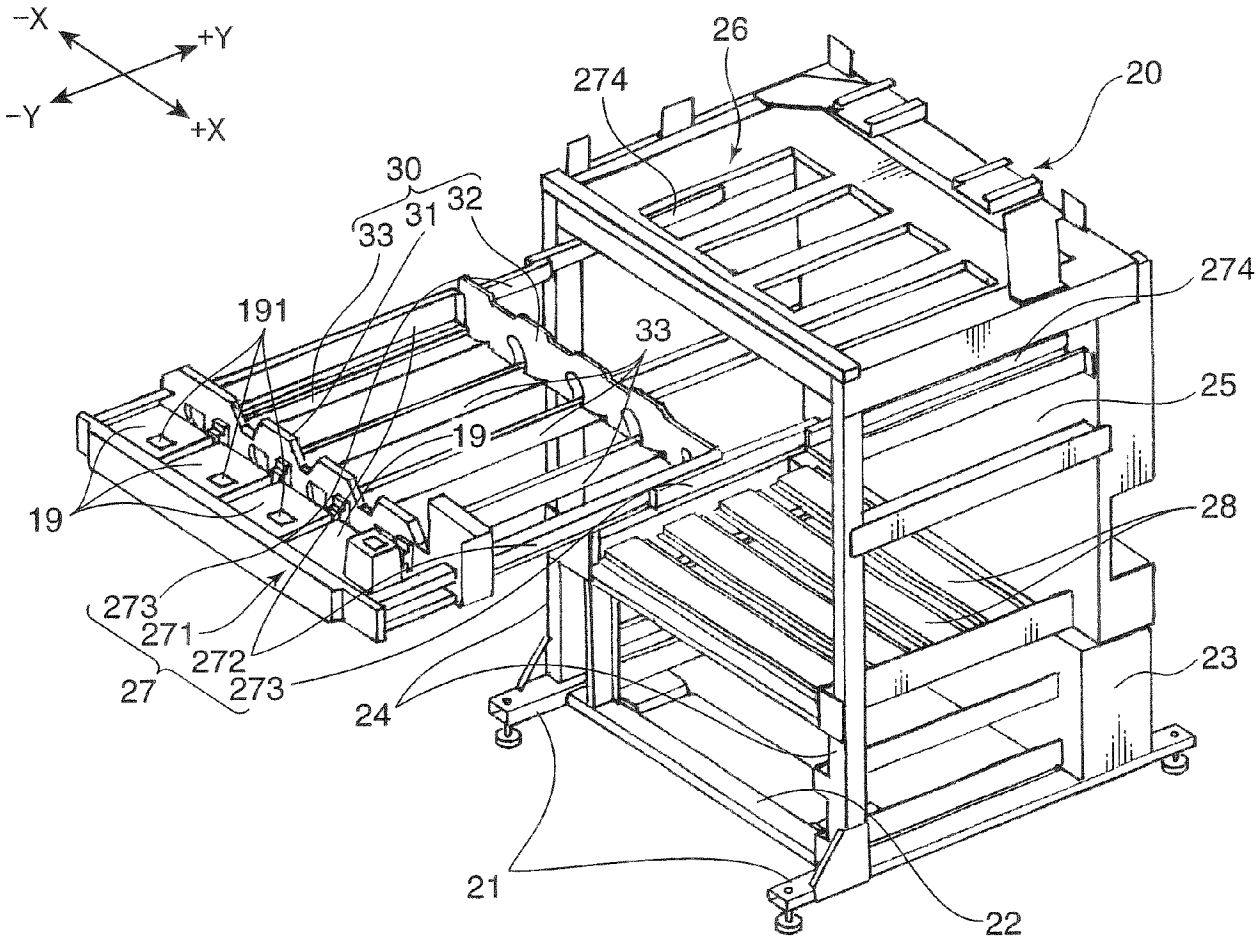
FIG. 3 is a perspective diagram showing the frame structure of the image forming apparatus, and illustrates a state where the drawer frame is pulled out.
Figure 4:
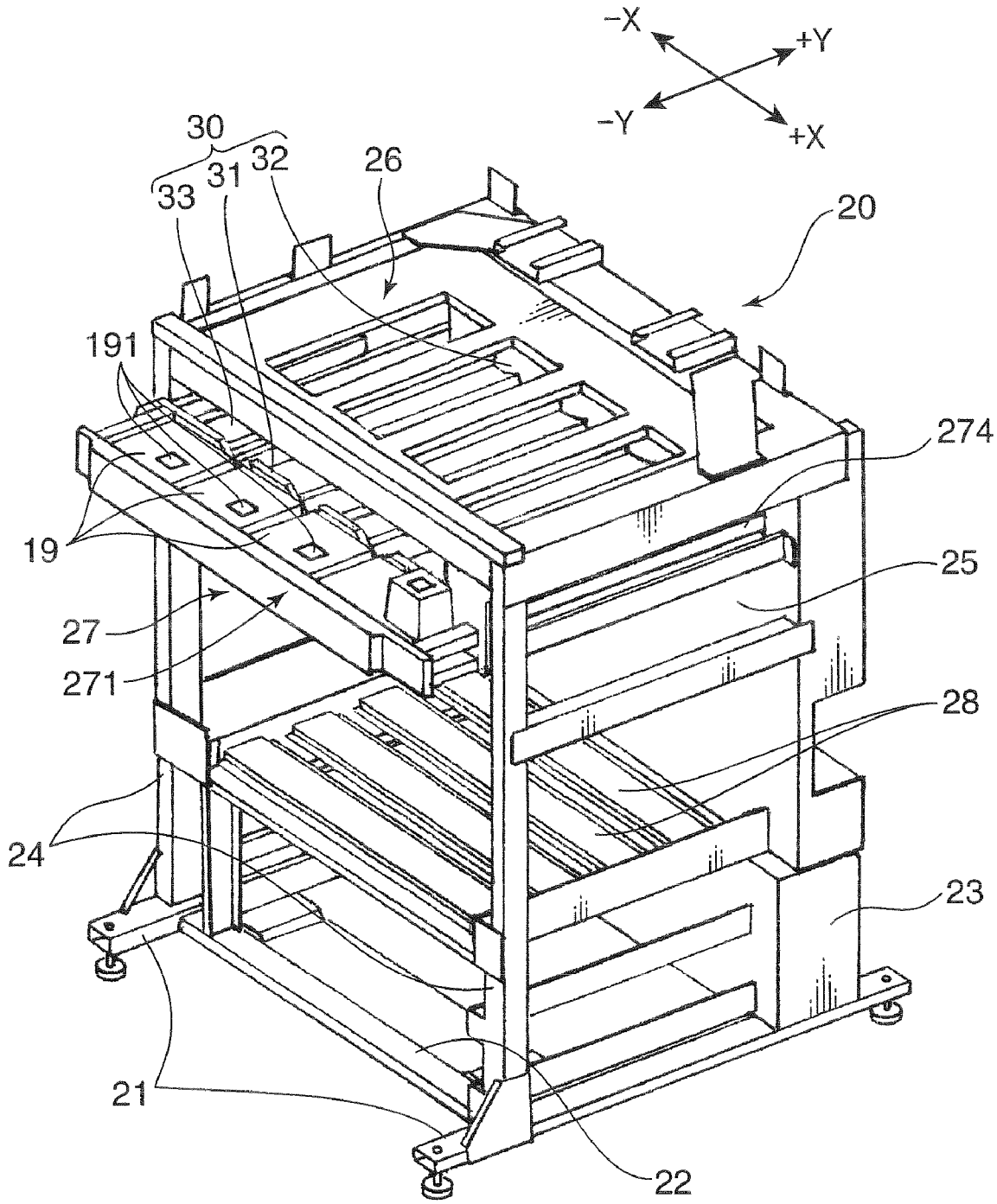
FIG. 4 is a perspective diagram showing a state where the drawer frame is accommodated in the frame structure shown in FIG. 3.

FIG. 3 and FIG. 4 are perspective diagrams showing the structure of the frame of the image forming apparatus 10; FIG. 3 shows a state where a drawer frame 27 has been drawn out from a rectangular parallelepiped-shaped frame 20, and FIG. 4 shows a state where the drawer frame 27 is accommodated therein. Furthermore, FIG. 5 is a perspective diagram showing developer apparatuses 122 and an image forming frame 30 relating to the first embodiment. The X and Y directions indicated in FIG. 3 to FIG. 5 are the same as those in FIG. 2 (X is the left/right direction (−X: leftward; +X: rightward) and Y is the forward/rearward direction (−Y: forward; +Y: rearward)).

As shown in FIG. 3, the frame structure comprises a rectangular parallelepiped-shaped frame 20 which has a rectangular parallelepiped shape in external view and corresponds to the main body of the apparatus 11. The rectangular parallelepiped-shaped frame 20 comprises: a left-hand and right-hand pair of floor beam frames 21, a front lower linking frame 22 which is provided spanning between the front edge portions of the pair of floor beam frames 21, a box frame 23 having a rectangular parallelepiped shape which is provided spanning between the rear edge portions of the floor beam frames 21, a left-hand and right-hand pair of pillar frames 24 provided in an erect fashion on the front edge portions of the respective floor beam frames 21, a board frame 25 provided in an erect fashion on a ceiling plate of the box frame 23, a ceiling frame 26 provided spanning between the upper edge section of the board frame 25 and the upper edge sections of the pair of pillar frames 24, a drawer frame 27 (drawer mechanism) removably installed between upper positions of the pair of pillar frames 24, and an image forming frame 30 (frame) which is installed on this drawer frame 27.

Partitioning frames 28 which partition the interior of the rectangular parallelepiped-shaped frame 20 into upper and lower regions are provided at approximately ⅓ of the height of the pillar frames 24 from the floor beam frames 21. A portion through which paper P is conveyed, which is constituted by a transfer belt 125 and a fixing unit 13, and the like, is provided between the partitioning frames 28 and the drawer frame 27. On the other hand, the paper storage unit 14, which consists of the two-stage paper tray 141, is disposed at a position below the partitioning frames 28. Furthermore, the image reading unit 16 is disposed at a position above the ceiling frame 26.

The drawer frame 27 comprises: an intermediate hopper supporting frame body 271 which is movable in the forward/rearward direction and is installed on a front side plate 31 portion (described hereinafter) of the image forming frame 30; a left-hand and right-hand pair of long and narrow side plates 272 extending in the forward/rearward direction which are provided on the left and right-hand edge portions of the image forming frame 30; and a left-hand and right-hand pair of movable guide rails 273 attached slidably in the forward and rearward direction respectively on the outer surface sides of the respective long and narrow side plates 272.

As shown in FIG. 3, the intermediate hopper supporting frame body 271 is moved through a predetermined distance in the forward direction when the drawer frame 27 is drawn out from the rectangular parallelepiped-shaped frame 20. Accordingly, the intermediate hopper 19 is moved forwards and the user is able to perform the operation of installing and removing the toner containers 15 readily. On the other hand, in a state where the drawer frame 27 is pushed into the rectangular parallelepiped-shaped frame 20, the supporting frame body 271 brings the intermediate hopper 19 toward the front side plate 31 and the intermediate hoppers 19 and the developer apparatuses 122 which are supported on the image forming frame 30 become mutually connected via linking tube members 122*b*, which are described below.

Figure 9A:
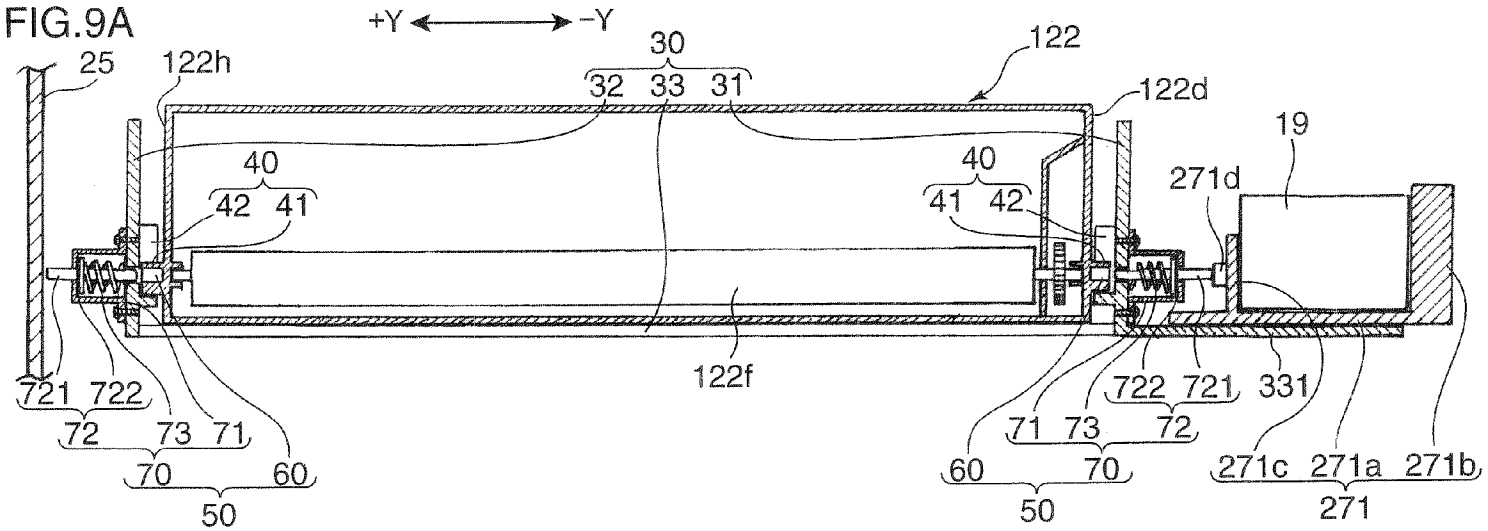
FIGS. 9A and 9B are cross-sectional diagrams for describing the operation of installing a developer apparatus.
Figure 9B:
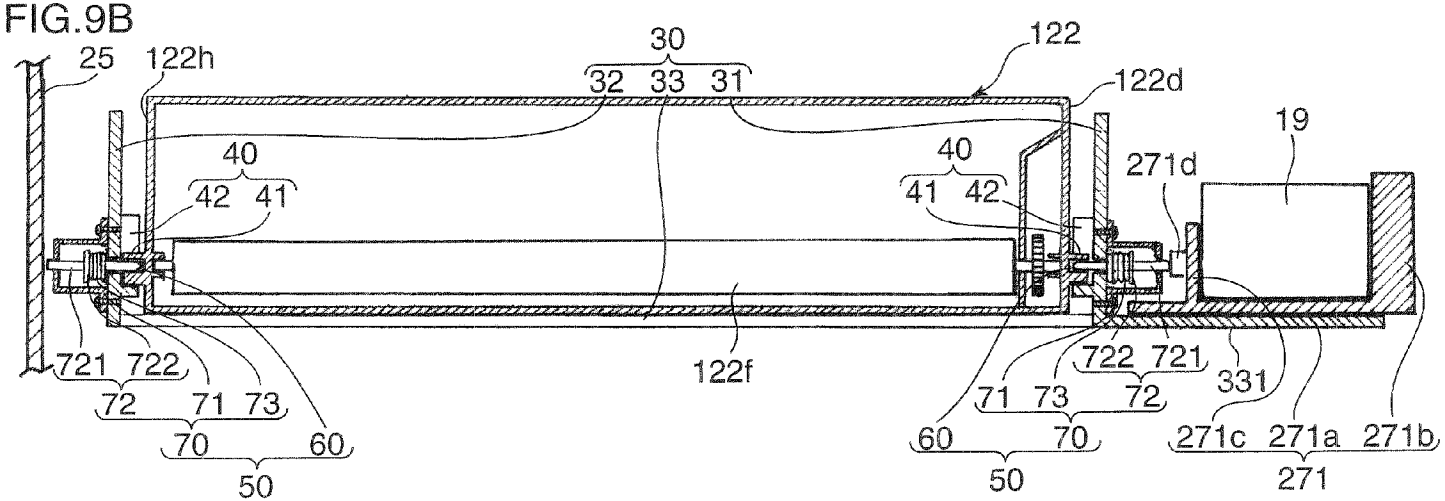

As shown in FIGS. 9A and 9B, the intermediate hopper supporting frame body 271 comprises: a base plate 271*a* which slides in the forward/rearward direction over an extension plate 331 which is provided extending from an installation plate 33, a cosmetic plate 271*b* which has a long dimension in the left/right direction and is provided in an standing fashion from the front edge portion of the base plate 271*a*, and a partitioning plate 271*c* which is provided in a standing fashion from the rear portion of the base plate 271*a*. The intermediate hoppers 19 are installed between the cosmetic plate 271*b* and the partitioning plate 271*c*. A pushing projection 271*d* (pushing member) for pushing against a rising movement prevention pin 72 (described hereinafter) is provided in a projecting fashion toward the rearward direction, on the partition plate 271*c*.

The intermediate hopper supporting frame body 271 has a locking mechanism (not illustrated) which operates in such a manner that it cannot be drawn forward when in a state of being pushed in towards the rearward direction. The locking of the locking mechanism is released by operating a lock release lever (not illustrated).

A left-hand and right-hand pair of fixed guide rails 274 (drawer mechanisms) which extend respectively in the rearward direction until the board frame 25 from mutually opposing surfaces are provided on top of the pair of pillar frames 24. The respective movable guide rails 273 are coupled, movably in the forward/rearward direction, to the corresponding fixed guide rails 274.

As shown in FIG. 3, in a state where the drawer frame 27 has been pulled out from the rectangular parallelepiped-shaped frame 20, the respective movable guide rails 273 assume a state where they are pulled out in the forward direction from the fixed guide rails 274, and furthermore the long and narrow side plates 272 assume a state where they are pulled out in the forward direction from the movable guide rails 273.

In order to accommodate the drawer frame 27 which is in a drawn out state inside the rectangular parallelepiped-shaped frame 20, the user pushes the cosmetic plate 271*b* in the rearward direction. In so doing, the movable guide rails 273 move in the rearward direction while being guided on the respectively corresponding fixed guide rails 274, and furthermore the long and narrow side plates 272 move in the rearward direction while being guided on the respectively corresponding movable guide rails 273, whereby the drawer frame 27 is accommodated inside the rectangular parallelepiped-shaped frame 20.

Four intermediate hoppers 19 as described above are arranged in the left/right direction in a front position of the drawer frame 27. The intermediate hopper 19 used for black toner from the black toner container 15K which is disposed on the furthest right-hand side is set to have a larger capacity than the intermediate hoppers 19 used for the other toners, namely, the magenta, cyan and yellow toners.

The image forming frame 30 is installed in a position to the rear of the intermediate hoppers 19 on the drawer frame 27. This image forming frame 30 serves to support, in the form of a single unit, the four photosensitive drums 121, the four developer apparatuses 122 and the four charging devices 123 of the respective units 12M, 12C, 12Y and 12K which are constituent elements of the image forming unit 12. The exposure apparatuses 124 are provided at positions above the image forming frame 30, so as to oppose the units 12M, 12C, 12Y and 12K.

As shown in FIG. 5, the image forming frame 30 comprises: a front side plate 31 (first wall surface), a rear side plate 32 (second wall surface) which is disposed opposing the front side plate 31 on the rear side, and a plurality of spanning plates 33 which are provided spanning between the lower edge portions of the front side plate 31 and the rear side plate 32. In FIG. 5, since the drawing otherwise becomes complicated and difficult to understand, a state is depicted in which the photosensitive drums 121 and the developer apparatuses 122 are installed between the front and rear side plates 31 and 32, but the charging devices 123 and the cleaning apparatuses 127 are omitted from the drawing.

Four clearance windows 311 arranged at a uniform pitch in the left/right direction are provided in the front side plate 31. The developer apparatuses 122 are installed between the side plates 31 and 32 of the image forming frame 30 in a state where a portion of each developer apparatus 122 (the linking tube member 122*b* which is described below) is inserted into the respective clearance windows 311.

The developer apparatuses 122 each have a housing 122*a* which is long in the forward/rearward direction, installed between the front and rear side plates 31 and 32 of the image forming frame 30, and a linking tube member 122*b* which is provided in a projecting fashion in the forward direction from the front-side end wall 122*d* (first side face) of the housing 122*a*. When installed in the image forming frame 30, the front-side end wall 122*d* of the housing 122*a* opposes the front side plate 31 and the rear-side end wall 122*h* (second side face) opposes the rear side plate 32.

When a developer apparatus 122 is installed between the front and rear side plates 31 and 32 of the image forming frame 30, the linking tube member 122*b* is inserted through the clearance window 311 in the front side plate 31 until a position below the corresponding intermediate hopper 19. By means of this inserting operation, the developer apparatus 122 assumes an installed state in the image forming frame 30, and furthermore toner from the toner container 15 (FIG. 1) can be replenished into the developer apparatus 122 via the intermediate hopper 19 and the linking tube member 122*b*.

A agitating conveyance member, such as a spiral feeder, which is not illustrated, and a developing roller 122*e* disposed in such a manner that the circumferential surface thereof opposes the circumferential surface of the photosensitive drum 121, are provided inside the housing 122*a* of the developer apparatus 122. A relay roller 122*f* (FIG. 7) which relays toner from the agitating conveyance member to the developing roller 122*e* is provided between the developing roller 122*e* and the agitating conveyance member.

The developer apparatus 122 is supported on the image forming frame 30 by means of a rocking support structure 40.

Figure 6:
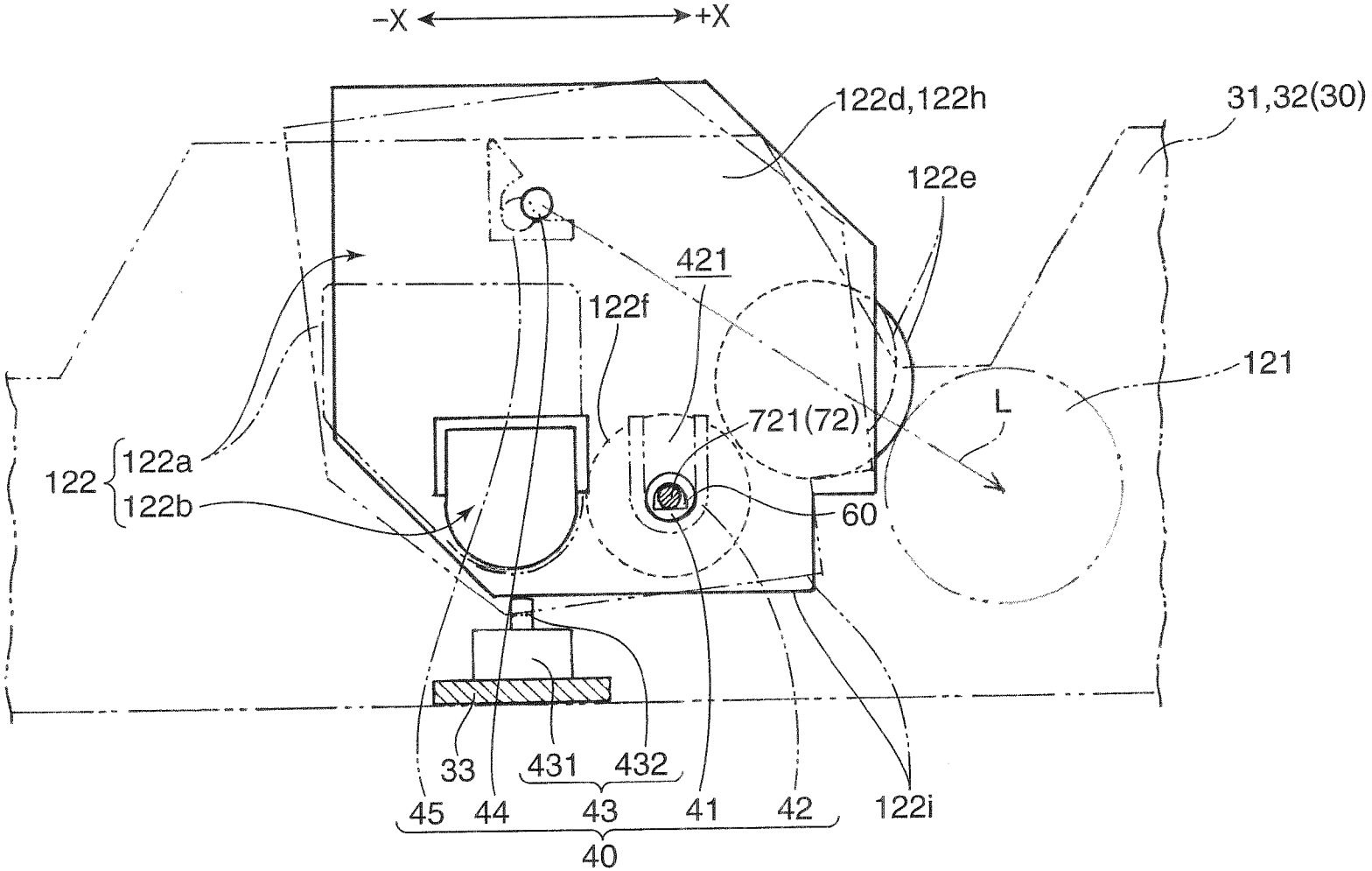
FIG. 6 is an explanatory diagram showing a front side view for describing a rocking support structure according to the first embodiment.

FIG. 6 is an explanatory diagram showing a front side view for describing a rocking support structure 40 according to the first embodiment. The direction indicated as X in FIG. 6 is the same as in the case of FIG. 1 (−X: leftward, +X: rightward).

The rocking support structure 40 comprises a pair of rocking fulcrum shafts 41 (a first fulcrum section and a second fulcrum section), a pair of installation groove members 42 (a first installation groove and a second installation groove), an posture changing drive member 43, a pair of spindles 44 and a pair of supporting pieces 45.

Of the pair of rocking fulcrum shafts 41, one of the rocking fulcrum shafts 41 (the first fulcrum section) is provided in a projecting fashion on the front-side end wall 122*d* of the developer apparatus 122, and the other rocking fulcrum shaft 41 (the second fulcrum section) is provided in a projecting fashion from the rear-side end wall 122*h*. These rocking fulcrum shafts 41 are a pair of members which project in respectively opposite directions and are disposed coaxially in the forward/rearward direction (the direction perpendicular to the plane of the drawing in FIG. 6).

Of the pair of installation groove members 42, one installation groove member 42 (a member having a first installation groove) is provided in a projecting fashion on the front side plate 31 of the image forming frame 30, and the other installation groove member 42 (a member having a second installation groove) is provided in a projecting fashion on the rear side plate 32, the two installation groove members 42 being disposed in mutually opposing positions. The respective rocking fulcrum shafts 41 are supported respectively on the installation groove members 42.

The posture changing drive member 43 is a member which changes the posture of the developer apparatus 122, and is installed in the central portion of the installation plate 33 which is provided spanning between the lower edge portions of the front and rear side plates 31 and 32. The pair of spindles 44 are provided so as to project in mutually opposite directions from upper positions on the front-side and rear-side end walls 122*d* and 122*h*. The pair of supporting pieces 45 are provided respectively on the front and rear side plates 31 and 32 so as to support the spindles 44.

The pair of rocking fulcrum shafts 41 are provided so as to be positioned coaxially with respect to the roller shaft 122*g* (rotating shaft; see FIG. 7) of the relay roller 122*f* (rotating body) which is provided in a position toward the right-hand side inside the housing 122*a* of the developer apparatus 122. The coaxial arrangement of this kind serves to prevent the occurrence of the problem of rocking of the developer apparatus 122 about the rocking fulcrum shafts 41 due to disruption of the balance of forces for transmitting drive power, when the relay roller 122*f* starts to rotate about the roller shaft 122*g* due to driving by a drive motor (not illustrated).

The pair of installation guide members 42 each have a U-shaped groove 421 which is open at the upper end (first installation groove and second installation groove). A circular arc base section 422 having a diameter of curvature slightly larger than the outer diameter dimension of the rocking fulcrum shafts 41 is formed in the base portion of each U-shaped groove 421. The rocking fulcrum shafts 41 are fitted into the U-shaped grooves 421 from the upper end openings, and are able to rotate forwards and backwards (in other words, perform a rocking movement) about a central axis while the outer circumferential surfaces thereof slide in a stable state against the circular arc base sections 422.

The rocking fulcrum shafts 41 are provided in positions toward the right-hand side in the developer apparatus 122, and hence the center of gravity is positioned to the left-hand side of the rocking fulcrum shafts 41 and this gives rise to a force which acts so as to rotate the developer apparatus 122 in the counter-clockwise direction about the rocking fulcrum shafts 41. The posture changing drive member 43 is provided above the installation plate 33 so as to correspond to a left-side position on the bottom section 122*i* of the frame of the developer apparatus 122, in such a manner that it opposes the aforementioned rotational force.

The posture changing drive member 43 comprises a solenoid member 431 inside which a solenoid is provided in a vertical posture, and an iron core 432 that is inserted into the solenoid in the solenoid member 431. The iron core 432 projects upwards beyond the solenoid member 431 due to the magnetization of the solenoid when current is passed through same, and the iron core 432 descends into the solenoid member 431 when the solenoid is demagnetized by shutting off the passage of current.

When the solenoid of the solenoid member 431 is demagnetized, the bottom section 122*i* of the frame of the developer apparatus 122 is supported on the iron core 432 that has descended and the posture is set to a non-developing posture as indicated by the double-dotted broken lines in FIG. 6 in which the developing roller 122*e* is separated from the photosensitive drum 121. On the other hand, when the solenoid of the solenoid member 431 is magnetized, the bottom section 122*i* of the frame of the developer apparatus 122 is pushed upwards by the iron core 432 that is raised up, thereby changing the posture to the developing posture indicated by the solid lines in FIG. 6, in which the developing roller 122*e* abuts against the circumferential surface of the photosensitive drum 121. The central axes of the spindles 44, the roller center of the developing roller 122*e* and the drum center of the photosensitive drum 121 are set to have a relative positional relationship whereby they are situated on the straight line L which is indicated by the single-dotted broken line shown in FIG. 6, when the posture of the developer apparatus 122 has been changed to the developing posture.

The developer apparatus 122 which is supported by the rocking support structure 40 and has been installed on the image forming frame 30 is prevented from rising up due to the action of the rising movement prevention structure 50 (the first supporting structure section and the second supporting structure section). When rotational driving of the relay roller 122*f* starts, an imbalance occurs in the forces acting on the developer apparatus 122, as a result of the drive torque, and therefore the rocking fulcrum shafts 41 in the U-shaped grooves 421 may rise upwards. The rising movement prevention structure 50 is provided in order to prevent rising movement of this kind.

Figure 7:
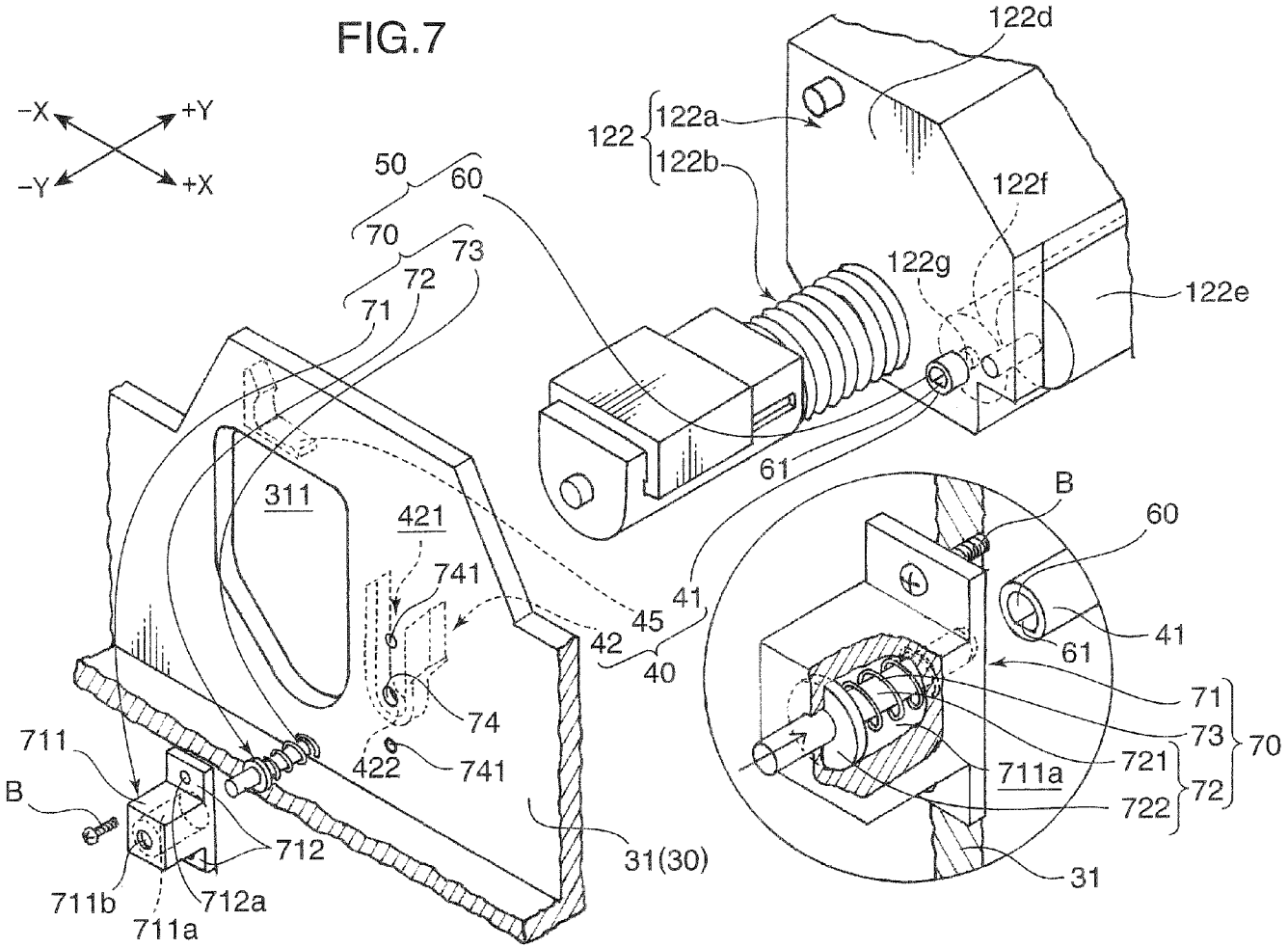
FIG. 7 is a partial cutaway exploded perspective diagram showing a rising movement prevention structure according to the first embodiment.
Figure 8:
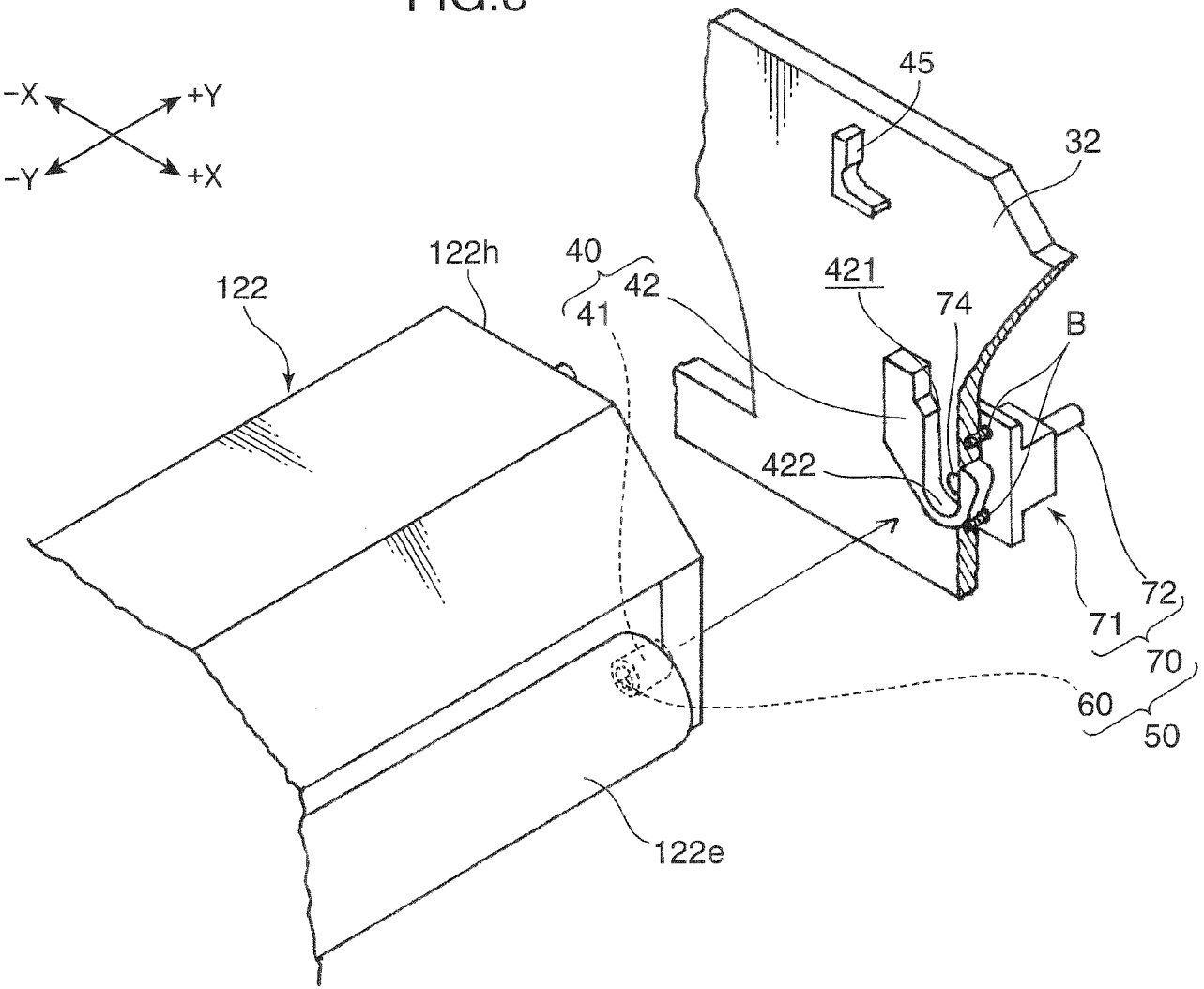
FIG. 8 is a partial cutaway exploded perspective diagram showing a rising movement prevention structure according to the first embodiment.

FIG. 7 and FIG. 8 are partial cutaway perspective diagrams showing the rising movement prevention structure 50 relating to the first embodiment. FIG. 7 shows a rising movement prevention structure 50 (first supporting structure section) on the front side plate 31 side of the image forming frame 30, and also shows, inside the circle, an enlarged partial cutaway perspective diagram of a pin member 70. FIG. 8 shows a rising movement prevention structure 50 (second supporting structure section) on the rear side plate 32 side of the image forming frame 30. The X and Y directions indicated in FIG. 7 and FIG. 8 are the same as those in FIG. 2 (X is the left/right direction (−X: leftward; +X: rightward) and Y is the forward/rearward direction (−Y: forward; +Y: rearward)).

The rising movement prevention structure 50 includes two positioning holes 60 and two pin members 70 (pins) corresponding to these. The positioning holes 60 are respectively formed in a recessed manner in the respective end faces of the rocking fulcrum shaft 41 at the front-side end wall 122*d* of the developer apparatus 122 and the rocking fulcrum shaft 41 at the rear-side end wall 122*h* (first positioning hole and second positioning hole). The pin members 70 are installed so as to correspond respectively to the rocking fulcrum shafts 41 on the outer surface side of the front side plate 31 of the image forming frame 30 and the outer surface side of the rear side plate 32 of same (first pin and second pin).

The positioning holes 60 each have a flat surface 61 extending in the horizontal direction on the bottom surface thereof, while the remainder of the hole has a round cylindrical shape. Consequently, the shape of the positioning holes 60 in front view is a circular arc shape.

The pin members 70 each comprise: a pin case 71 which is fixed to the front side plate 31 or the rear side plate 32, a rising movement prevention pin 72 which is installed so as to pass through this pin case 71, and a coil spring 73 (biasing member) which applies an biasing force to the rising movement prevention pin 72.

The pin case 71 comprises a rectangular parallelepiped-shaped pin case main body 711 and a pair of brackets 712 provided extending in the upward and downward directions from the rear end edge portion of the pin case main body 711. A bottomed circular installation hole 711*a* formed by boring from the rear end surface is provided in the pin case main body 711 in order to install the rising movement prevention pin 72.

The circular installation hole 711*a* is set to have a diameter larger than the diameter dimension of the rising movement prevention pin 72. An insertion hole 711*b* which allows passage of the front portion of the rising movement prevention pin 72 is bored in the bottom portion at the front end of the circular installation hole 711*a*. Screw clearance holes 712*a* for fixing the pin case 71 to the front/rear side plate 31, 32 by passing screws B through same are formed in the upper and lower brackets 712.

The rising movement prevention pin 72 comprises a round bar-shaped pin main body 721 and a flange 722 which is fixed externally in a coaxial fashion, at a position slightly toward the forward side from the central portion of the pin main body 721. The pin main body 721 is set to have a diameter which is slightly smaller than the diameter of the insertion hole 711*b* of the pin case 71. The rising movement prevention pin 72 is installed in the circular installation hole 711*a* in a state where the front end portion of the pin main body 721 is inserted into the circular installation hole 711*a* from the rear surface opening and passed through the insertion hole 711*b*, and the flange 722 is abutted against base of the circular installation hole 711*a*. The length dimension of the pin main body 721 is set in such a manner that, in this installed state, the rear portion of the pin main body 721 projects externally from the circular installation hole 711*a*.

The coil spring 73 imparts a biasing force in a direction away from the positioning hole 60 (the −Y direction in FIG. 7) to the rising movement prevention pin 72 which has been installed in the pin case 71. The internal diameter of the coil spring 73 is set to be larger than the diameter dimension of the pin main body 721, and furthermore, the external diameter of the coil spring 73 is set to be smaller than the diameter of the flange 722 and the length dimension thereof is set to be somewhat longer than the depth of the circular installation hole 711*a* of the pin case 71.

As shown inside the circle in FIG. 7, the coil spring 73 is fitted externally on the pin main body 721 on the portion in front of the flange 722, in a state where the rising movement prevention pin 72 is installed in the circular installation hole 711*a* of the pin case main body 711.

On the other hand, through holes 74 for passing the pin main body 721 are bored respectively in the front side plate 31 and the rear side plate 32, at positions opposing the rocking fulcrum shafts 41 in a state where the developer apparatus 122 is installed on the image forming frame 30. Moreover, screw holes 741 corresponding to the respective screw clearance holes 712*a* are bored respectively at positions above and below each through hole 74.

During assembly, the rising movement prevention pins 72 with the coil springs 73 respectively fitted externally onto the pin main bodies 721 are installed in the pin cases 71. Subsequently, the screws B are passed respectively through the screw clearance holes 712*a* of the brackets 712 and are fastened into the respective screw holes 741. By this means, as shown in the circle portion in FIG. 7 and FIG. 8, the pin members 70 are fixed to the front side plate 31 or the rear side plate 32 of the image forming frame 30.

In this state, the coil springs 73 inside the circular installation holes 711*a* are compressed under pressure between the flange 722 and the front side plate 31 or rear side plate 32, thereby biasing the pin main bodies 721 toward the rear portion of the circular installation holes 711*a* via the flanges 722. Consequently, in this state, the front ends of the pin main bodies 721 do not project externally from the front side plate 31 or rear side plate 32. More specifically, in a state where the pin main body 721 is positioned in the rear portion of the circular installation hole 711*a* due to the biasing force of the coil spring 73, the front end portion of the pin main body 721 is held in the through hole 74 of the front side plate 31 or rear side plate 32, without the front end projecting from the front side plate 31 or rear side plate 32.

On the other hand, when the developer apparatus 122 is installed in the image forming frame 30, whereby the respective rocking fulcrum shafts 41 of the developer apparatus 122 assume a state of being respectively fitted into and supported by the U-shaped grooves 421 of the installation groove members 42, then the pin main bodies 721 are pressed respectively in mutually approaching directions, as described below, and the front ends thereof project. Therefore, the front ends of the pin main bodies 721 project respectively toward the inside of the image forming frame 30 from the through holes 74 and fit into the positioning holes 60 of the rocking fulcrum shafts 41. By this means, rising up of the developer apparatus 122 is prevented in a reliable fashion.

Below, the operation of installing a developer apparatus 122 onto the image forming frame 30 is described on the basis of FIGS. 9A and 9B, with reference to other drawings where necessary. FIGS. 9A and 9B are cross-sectional diagrams for describing the operation of installing a developer apparatus 122. FIG. 9A shows a state where the rising movement prevention pins 72 are not inserted into the positioning holes 60 of the rocking fulcrum shafts 41 of the developer apparatus 122, and FIG. 9B shows a state where the rising movement prevention pins 72 are inserted into the positioning holes 60. The direction indicated by Y in FIGS. 9A and 9B is the same as that in FIG. 2 (−Y: forward; +Y: rearward).

When installing the developer apparatus 122 on the image forming frame 30, firstly, as shown in FIG. 3, the user draws out the drawer frame 27 from the rectangular parallelepiped-shaped frame 20, and then separates the intermediate hopper supporting frame body 271 of the drawer frame 27 from the front side plate 31, in the forward direction. In this state, the user then fits the developer apparatus 122 in between the front and rear side plates 31 and 32 of the image forming frame 30. In so doing, as shown in FIG. 9A, the positioning holes 60 of the front and rear rocking fulcrum shafts 41 of the developer apparatus 122 assume a state of respectively opposing the rising movement prevention pins 72 of the pin members 70 which are provided on the front and rear side plates 31 and 32.

In this state, if the intermediate hopper supporting frame body 271 is pushed in toward the rearward direction, then the end face of the pushing projection 271*d* (pushing member) which is provided so as to project toward the rear from the partitioning plate 271*c* of the intermediate hopper supporting frame 271 pushes the rising movement prevention pin 72 of the front pin member 70 in the rearward direction. Due to this pushing action, firstly, the drawer frame 27 (FIG. 3) which has been drawn out from the rectangular parallelepiped-shaped frame 20 is pushed into the rectangular parallelepiped-shaped frame 20 as shown in FIG. 4.

Immediately after the image forming frame 30 has been pushed into the rectangular parallelepiped-shaped frame 20, as shown in FIG. 9A, the coil springs 73 are in an extended state and the end face of the front-side rising movement prevention pin 72 abuts against the pushing projection 271*d* of the intermediate hopper supporting frame body 271, and furthermore, the end face of the rear-side rising movement prevention pin 72 is abutted and held against the board frame 25 (pushing member) of the rectangular parallelepiped-shaped frame 20.

From the state in FIG. 9A, if the user then pushes the intermediate hopper supporting frame body 271 further in the rearward direction against the biasing force of the coil spring 73, the front-side rising movement prevention pin 72 moves in the rearward direction against the biasing force of the coil spring 73. By this means, the rising movement prevention pin 72 fits into the positioning hole 60 of the front-side rocking fulcrum shaft 41, as shown in FIG. 9B. Furthermore, the rear-side rising movement prevention pin 72 is pressed relatively by the board frame 25 and fits into the positioning hole 60 in the rear-side rocking fulcrum shaft 41. By this means, the developer apparatus 122 assumes a state of being installed on the image forming frame 30 in a registered position.

The state of the intermediate hopper supporting frame body 271 which is pushed in toward the rear direction on the extension plate 331 of the image forming frame 30 is locked by a locking device, which is not illustrated.

If a developer apparatus 122 which has been installed in the image forming frame 30 is to be temporarily removed from the image forming frame 30, then the user must release the locked state created by the locking device. In so doing, the rising movement prevention pins 72 are withdrawn from the positioning holes 60 of the rocking fulcrum shafts 41 due to the biasing force of the coil springs 73. Therefore, after pulling the image forming frame 30 out from the rectangular parallelepiped-shaped frame 20, the developer apparatus 122 can be removed from the image forming frame 30.

As stated in detail above, the image forming apparatus 10 according to the present embodiment includes a rising movement prevention structure 50 which prevents rising movement of the rocking fulcrum shafts 41 of the developer apparatus 122 that have been fitted into the U-shaped grooves 421. Therefore, even if a rising force acts on the developer apparatus 122 during an image forming process, due to the effects of driving the agitating member inside the developer apparatus 122, or the like, then rising movement of the developer apparatus 122 is restricted. Consequently, it is possible to carry out a correct image forming process in the image forming apparatus 10.

Furthermore, the rising movement prevention structure 50 according to the first embodiment includes positioning holes 60 provided in a recessed manner in the end faces of the respective rocking fulcrum shafts 41 and rising movement prevention pins 72 provided so as to correspond to these positioning holes 60. Consequently, it is possible to prevent rising up of the developer apparatus 122 by means of a simple composition which involves inserting the rising movement prevention pins 42 into the positioning holes 60.

Moreover, the positioning holes 60 have a flat surface 61 on the bottom surface thereof. If the positioning holes 60 are provided with a circular shape coaxially with the rocking fulcrum shafts 41, then in a state where the center of the rising movement prevention pin 72 keeps centering, it is not possible to align the centers of the positioning hole 60 and the rising movement prevention pin 72 unless the outer circumference of the pin coincides with the inner circumference of the hole. However, if the flat surface 61 is provided, while the center of the rising movement prevention pin 72 keeps centering, it is sufficient to make the lower portion of the pin coincide with the flat surface 61. The positioning holes 60 are circular arc-shaped holes in cross-sectional view, and consequently, the cross-section of the positioning holes 60 is made larger than the cross-sectional area of the rising movement prevention pins 72. Therefore, the operation of inserting the rising movement prevention pins 72 into the positioning holes 60 can be carried out easily. Furthermore, when insertion is completed, the rising movement prevention pins 72 interfere with the flat surfaces 61 and rising up of the developer apparatus 122 can be prevented in a reliable fashion.

Second Embodiment

Figure 10A:
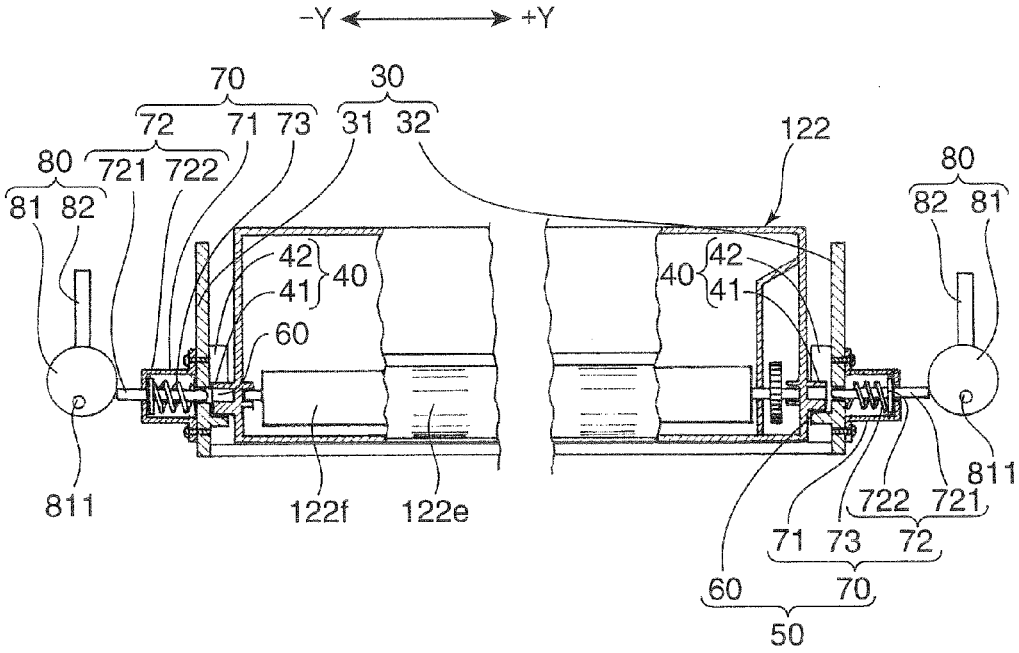
FIGS. 10A and 10B are cross-sectional diagrams for describing a rising movement prevention structure according to a second embodiment.
Figure 10B:
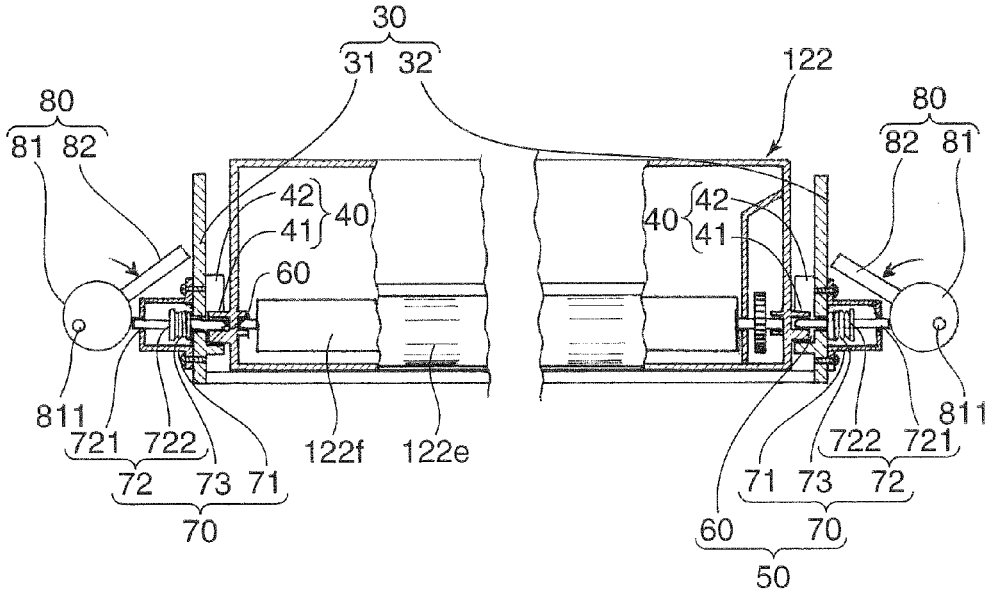

FIGS. 10A and 10B are cross-sectional diagrams for describing the rising movement prevention structure according to a second embodiment. In the first embodiment described above, an example was described in which the operation of installing and removing the developer apparatus 122 with respect to the image forming frame 30 is carried out in linkage with the operation of the intermediate hopper supporting frame body 271. The second embodiment describes an example in which the developer apparatus 122 is installed and removed by an operation of the operating member (pin projection operating member 80).

FIGS. 10A and 10B are explanatory diagrams showing cross-sectional views of the image forming frame 30 and the developer apparatus 122, and the like, in order to explain the operation of installing and removing the developer apparatus 122 with respect to the image forming frame 30 by using pin projection operating members 80. FIG. 10A shows a state where the rising movement prevention pins 72 are not inserted into the positioning holes 60 of the rocking fulcrum shafts 41 of the developer apparatus 122, and round eccentric cams 81 are set in a released posture, and FIG. 10B shows a state where the rising movement prevention pins 72 are inserted into the positioning holes 60 and round eccentric cams 81 are set in a rising movement preventing posture. The direction indicated by Y in FIGS. 10A and 10B is the same as that in FIGS. 9A and 9B (−Y: forward; +Y: rearward).

The pin projection operating members 80 are provided at suitable positions inside the image forming frame 30, so as to press on the rising movement prevention pins 72 and cause same to project inside the image forming frame 30. The pin projection operating members 80 are provided respectively on the outer sides of the front and rear side plates 31 and 32 of the image forming frame 30, and each comprise a round eccentric cam 81 supported rotatably about a spindle 811 which extends in the left/right direction (the direction perpendicular to the plane of the drawing in FIG. 10A) and an operating lever 82 provided so as to project in the radial direction from the round eccentric cam 81.

The spindles 811 are provided at positions slightly removed in the left/right direction from the base ends of the pin main bodies 721, at substantially the same height as the rising movement prevention pins 72. Each of the round eccentric cams 81 is disposed in such a manner that its center position is substantially directly above the corresponding spindle 811 and slightly removed from the spindle 811, when the front end of the pin main body 721 is in a removed state from the positioning hole 60 (in a released posture). The circumferential surface of the round eccentric cam 81 abuts against the base end portion of the pin main body 721. The operating lever 82 is provided so as to project upwards from the top part of the round eccentric cam 81, when the round eccentric cam 81 is set to the released posture.

When the round eccentric cams 81 are in the released posture (FIG. 10A), if the user operates the respective operating levers 82 in mutually approaching directions, then the respective round eccentric cams 81 rotate in mutually opposite directions about the spindles 811. More specifically, the front-side round eccentric cam 81 rotates in the clockwise direction about the spindle 811, and the rear-side round eccentric cam 81 rotates in the counter-clockwise direction about the spindle 811. Thereby, the respective round eccentric cams 81 assume a rising movement prevention posture, as shown in FIG. 10B.

Due to this rotation, the base end sides of the respective pin main bodies 721 are pressed by the circumferential surfaces of the round eccentric cams 81. The respective pin main bodies 721 which are pressed in this way respectively advance in mutually approaching directions against the biasing forces of the coil springs 73 and pass into the positioning holes 60 which are supported on the installation groove members 42 provided in the front and rear side plates 31 and 32. By this means, rising up of the developer apparatus 122 is prevented.

When the round eccentric cams 81 are disposed in the rising movement preventing posture, since the spindles 811 are disposed substantially on the line of extension of the central axes of the pin main bodies 721, then the biasing forces of the coil springs 73 produce virtually no moment on the round eccentric cams 81. Consequently, the round eccentric cams 81 are maintained in the rising movement preventing posture.

When the developer apparatus 122 installed on the image forming frame 30 is to be removed from the image forming frame 30, the user needs to rotate the operating levers 82, which are in an inclined state, about the spindles 811 so as to assume an upright position. In so doing, the circumferential surfaces of the round eccentric cams 81 which have been pressed against the base end portions of the pin main bodies 721 become separated from the pin members 70 and therefore the pin main bodies 721 move respectively in mutually separating directions due to the biasing forces of the coil springs 73. Consequently, the front ends of the pin main bodies 721 are respectively removed from the positioning holes 60. When the operating levers 82 assume an upright state (released posture), the front ends of the pin main bodies 721 are removed completely from the positioning holes 60, and therefore it is possible to remove the developer apparatus 122 from the image forming frame 30.

By providing pin projection operating members 80 having an extremely simple structure of this kind, it becomes unnecessary to link the operation of the projection of the rising movement prevention pins 72 with the forward and rearward movement of the intermediate hopper supporting frame body 271. Consequently, a reduction in apparatus costs can be obtained, as well as achieving excellent versatility of the installation structure of the developer apparatus 122.

Third Embodiment

Figure 11:
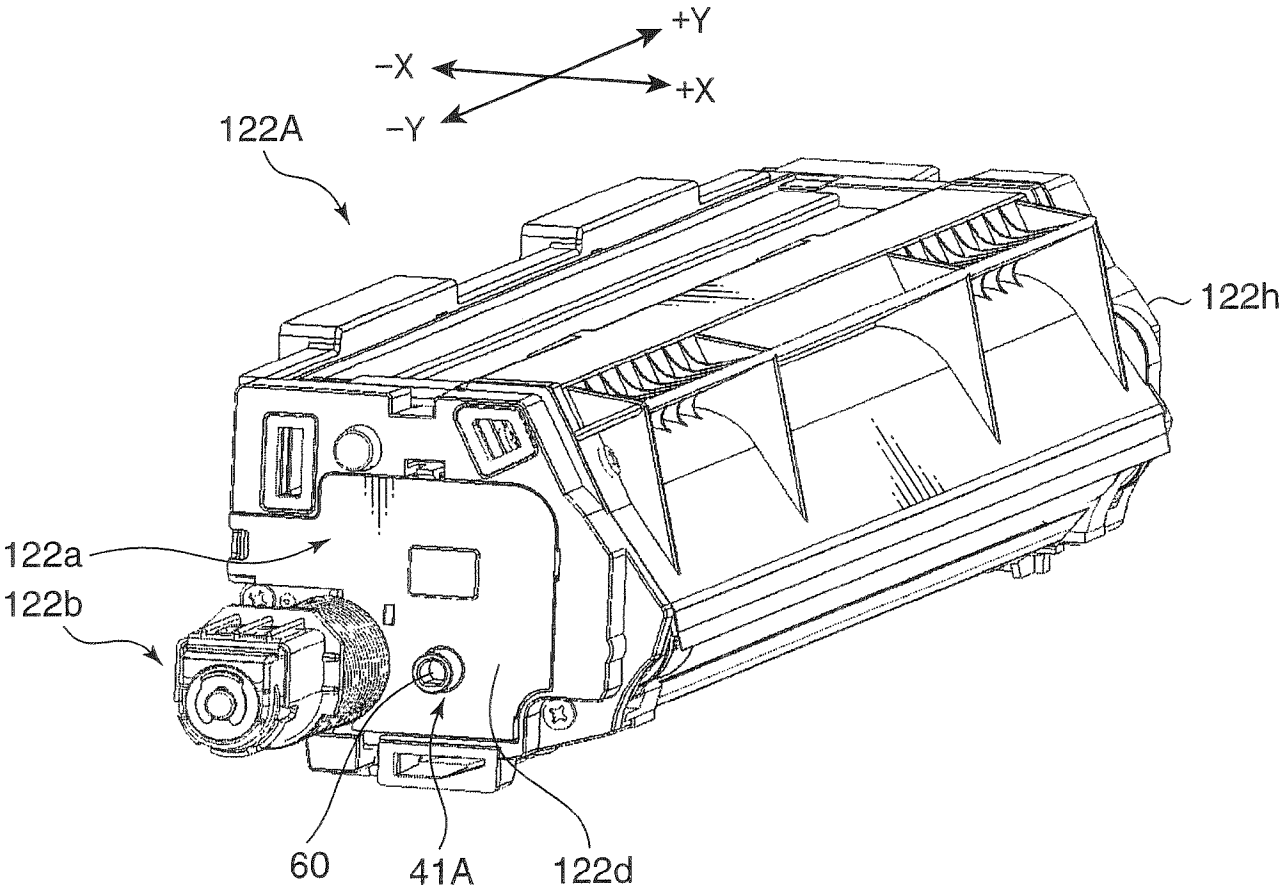
FIG. 11 is a perspective diagram showing a developer apparatus relating to a third embodiment.
Figure 12:
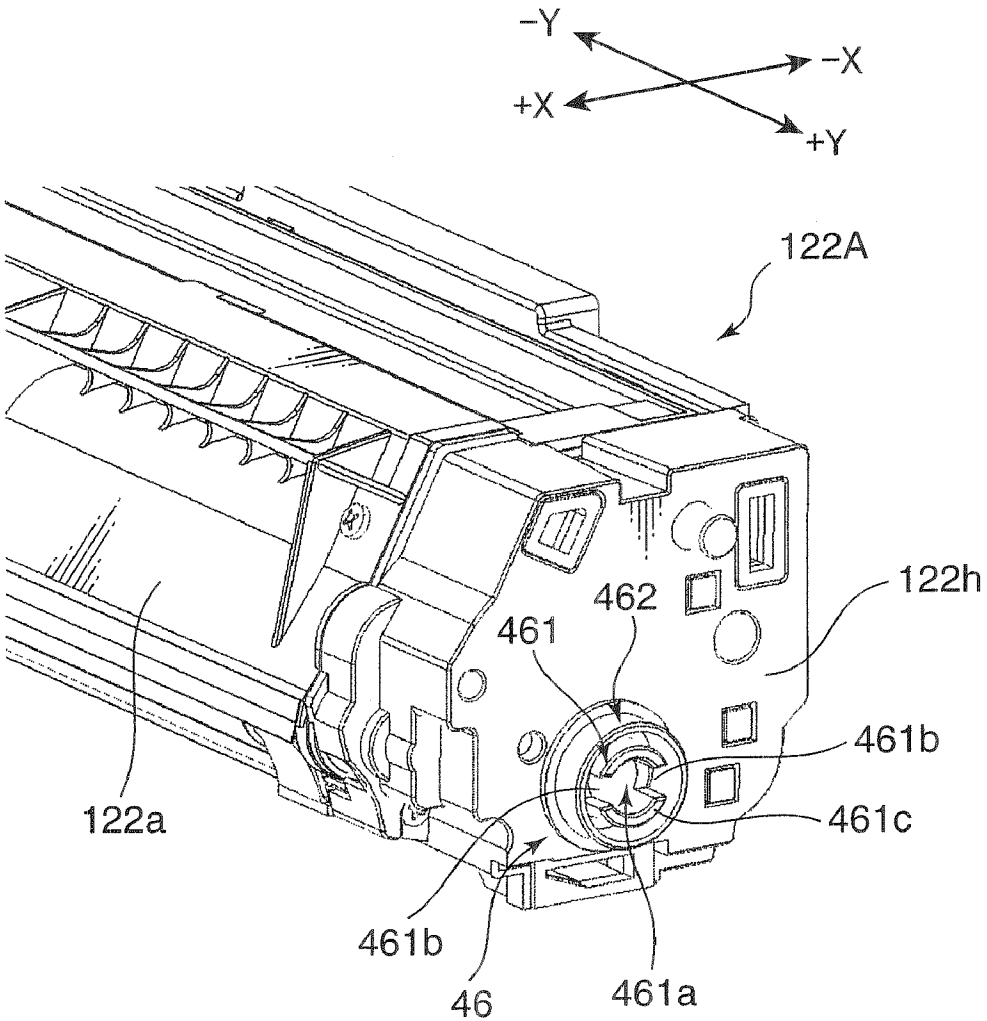
FIG. 12 is a perspective diagram showing a developer apparatus relating to a third embodiment, as viewed from the opposite direction.
Figure 13:
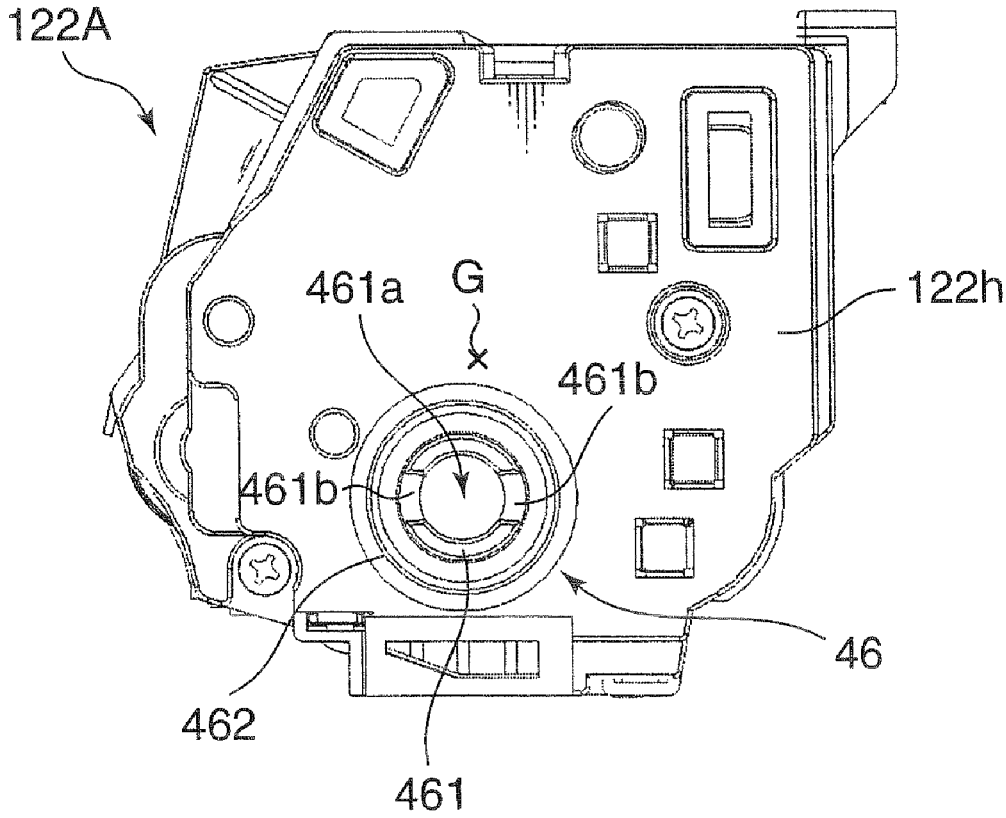
FIG. 13 is a side view diagram of a developer apparatus.
Figure 14:
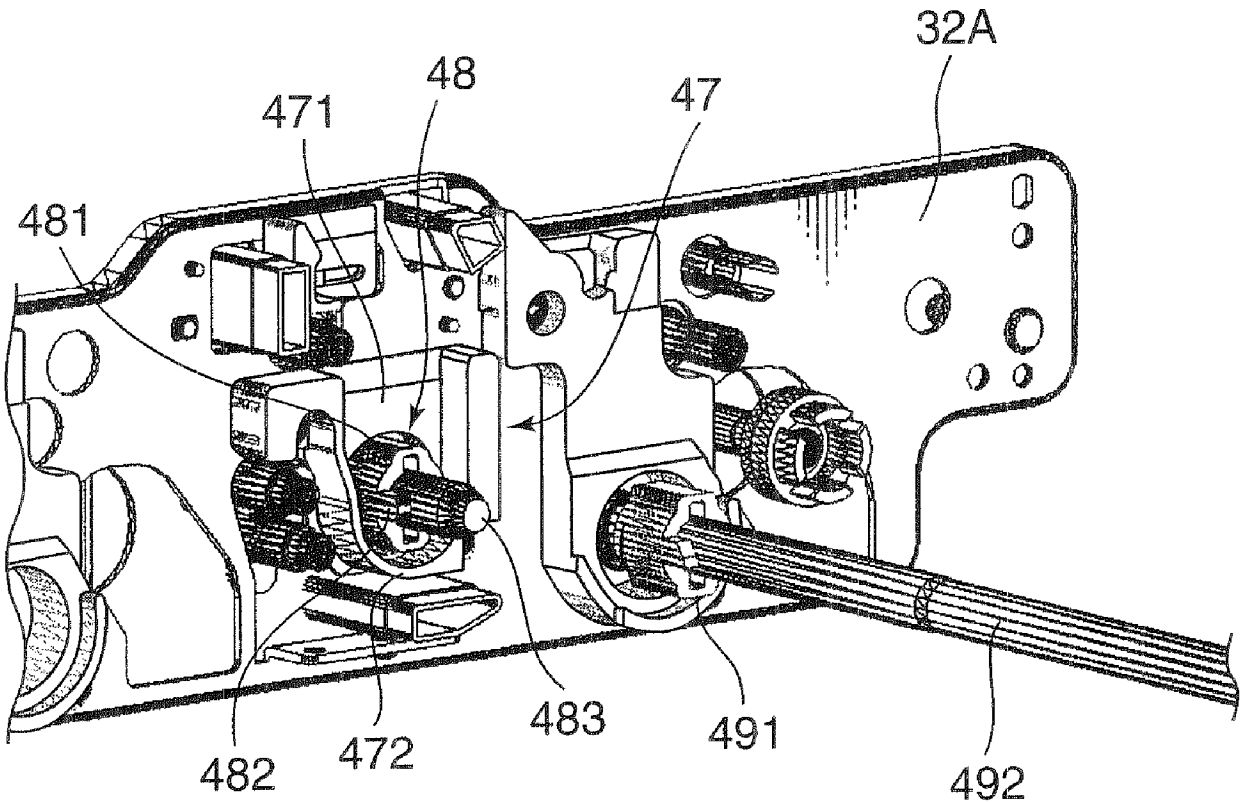
FIG. 14 is a perspective diagram showing an image forming frame and a drive shaft.
Figure 15:
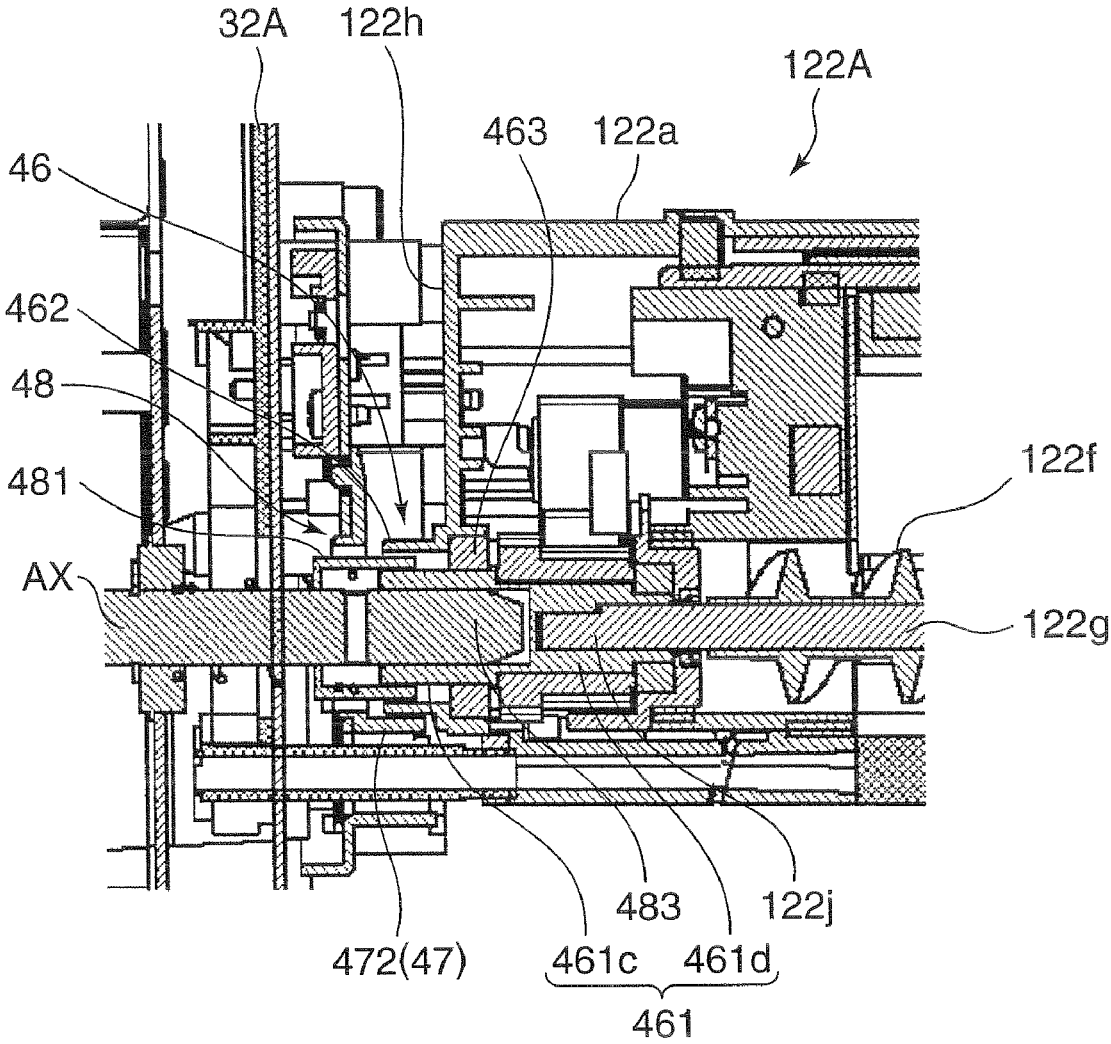
FIG. 15 is a cross-sectional diagram showing a rising movement prevention structure according to the third embodiment.

FIG. 11 is a perspective diagram of the developer apparatus 122A relating to a third embodiment as viewed from the front side (−Y direction), FIG. 12 is a perspective diagram of the developer apparatus 122A as viewed from the rear side (+Y direction), and FIG. 13 is a side face diagram of the rear side of the developer apparatus 122A. Furthermore, FIG. 14 is a perspective diagram showing a rear side plate 32A of an operating frame and a drive shaft; and FIG. 15 is a cross-sectional diagram showing the rising movement prevention structure according to a third embodiment.

In the first and second embodiments, examples were described in which rocking fulcrum shafts 41 having positioning holes 60 are formed similarly in both the front-side end wall 122*d* and the rear-side end wall 122*h* of the developer apparatus 122. The third embodiment describes an example in which the rocking fulcrum shaft 41A on the side of the rear-side end wall 122*h* is provided in a straight coupling type of joint section that transmits drive force from the apparatus main body 11 to the developer apparatus 122A.

Similarly to the first and second embodiments, the developer apparatus 122A comprises a housing 122*a* which stores toner and a linking tube member 122*b* for supplying the toner to the housing 122*a*. As shown in FIG. 11, a first rocking fulcrum shaft 41A (first fulcrum section) having a positioning hole 60 is provided in a projecting fashion on the front-side end wall 122*d*. This first rocking fulcrum shaft 41A is similar to the rocking fulcrum shaft 41 according to the first and second embodiments which were described above, and therefore further explanation thereof is omitted here.

On the other hand, a second rocking fulcrum shaft 46 (second fulcrum section) is provided in a projecting fashion on the rear-side end wall 122*h*. This second rocking fulcrum shaft 46 is provided on a relay roller 122*f* (rotating body, see FIG. 15) inside the developer apparatus 122A, in a joint section for transmitting a drive force from the apparatus main body 11. The second rocking fulcrum shaft 46 comprises a first joint piece 461 on the developer apparatus 122A side, and a tubular section 462 (second supporting section) provided about the perimeter of the first joint piece 461.

The first joint piece 461 constitutes one straight coupling type of joint, and as shown in FIG. 15, is installed on the end of the rotating shaft 122*g* of a relay roller 122*f*. The first joint piece 461 comprises: a drive input section 461*c* having a tubular space 461*a* into which a positioning shaft 483 (described hereinafter) is inserted, and a pair of engaging grooves 461*b* formed by cutting away the perimeter wall surface of the tubular space 461*a*; and a fixed section 461*d* which is fixed to the end of the rotating shaft 122*g*. The drive input section 461*c* is supported rotatably on a bearing 463 which is disposed in the vicinity of the rear-side end wall 122*h*. The tubular section 462 is a round cylindrical body that surrounds this first joint piece 461. The tubular section 462 and the first rocking fulcrum shaft 41A are disposed coaxially.

As shown in FIG. 14, an installation groove member 47 which supports the second rocking fulcrum shaft 46 is provided in a projecting fashion on the rear side plate 32A of the image forming frame 30 which opposes the second rocking fulcrum shaft 46. The installation groove member 47 includes a U-shaped groove 471 (second installation groove) which is open on the upper end. The tubular section 462 is fitted into this U-shaped groove 471 and is supported by the circular arc-shaped base portion 472 of the U-shaped groove 471.

A second joint piece 48 on the apparatus main body 11 side is disposed so as to project from a through hole provided in the rear side 32A. The second joint piece 48 comprises a main body section 481 which is attached to a drive shaft AX on the apparatus main body 11 side that is driven to rotate by a motor (not illustrated), and a pair of projecting sections 482 which fit into the pair of engaging grooves 462*b* in the first joint piece 461. By the coupling together of the engaging grooves 462*b* and the projecting sections 482, the first joint piece 461 and the second joint piece 48 assume a state capable of transmitting torque, in such a manner that the drive force of the drive shaft AX is transmitted to the rotating shaft 122*g* of the relay roller 122*f*. A coupling section 491 which transmits drive force to a drive shaft 492 of the photosensitive drum 121 is provided alongside the second joint piece 48.

The front end portion of the drive shaft AX functions as a positioning shaft 483. The positioning shaft 483 is a portion that projects forwards from the main body section 481 and is inserted tightly into the tubular space 461*a* (insertion hole) provided in the drive input section 461*c* of the first joint piece 461 (FIG. 12). By means of this inserting operation, the developer apparatus 122A is registered in position with respect to the apparatus main body 11, and furthermore, rising up of the second rocking fulcrum shaft 46 from the installation groove member 47 is prevented. The drive shaft AX (positioning shaft 483) is disposed coaxially with the rotating shaft 122*g* of the relay roller 122*f*.

In a state where the image forming frame 30 has been pulled out from the rectangular parallelepiped-shaped frame 20 (FIG. 3), the rear-side end wall 122*h* side of the developer apparatus 122A is supported by the installation groove member 47 on the rear side plate 32A, in the tubular section 462. On the other hand, in a state where the image forming frame 30 is accommodated in the rectangular parallelepiped-shaped frame 20 and the first joint piece 461 and the second joint piece 48 are coupled together, then the rear-side end wall 122*h* side of the developer apparatus 122A is supported substantially by the positioning shaft 483.

Here, as shown in FIG. 13, the first joint piece 461 is disposed in a position at the rear-side end wall 122*h* which is directly below the position of the central axis G in the forward/rearward direction of the developer apparatus 122A. This factor contributes to reducing relatively the pressing force of the developing roller 122*e* pressing against the photosensitive drum 121, due to the rotation of the developer apparatus 122A about the first rocking fulcrum shaft 41A and the second rocking fulcrum shaft 46. It is desirable if the second rocking fulcrum shaft 46 is disposed at a position on the central axis G, since this reduces the aforementioned pressing force to a minimum.

According to the third embodiment which was described above, it is possible to prevent the developer apparatus 122A from rising up from the image forming frame 30, by utilizing a positioning shaft 483 which is provided in a straight coupling type of joint section. Furthermore, since the developer apparatus 122A is registered in position with good accuracy by the positioning shaft 483, then it is possible to suppress variation in the distance (parallelism) between the developing roller 122*e* and the photosensitive drum 121.

Further Embodiments

Three embodiments of the present invention were described above, but the present invention can also be implemented in the following embodiments.

(1) In the foregoing embodiment, a copying machine was described as an example of an image forming apparatus 10. The image forming apparatus 10 may also be a printer, or a facsimile apparatus.

(2) In the first embodiment, it is possible to adopt a composition in which, by installing the developer apparatus 122 on the image forming frame 30, the rising movement prevention pins 72 are automatically fitted into the positioning holes 60 in the end faces of the rocking fulcrum shafts 41 in a linked fashion with this installation operation. By adopting this composition, measures against rising movement of the developer apparatus 122 can be implemented readily, compared to a case where the rising movement prevention pins 72 are inserted into the positioning holes 60 manually, one by one.

(3) In the first embodiment, an example was described in which the rising movement prevention pins 72 which are biased in a direction away from the positioning holes 60 of the rocking fulcrum shafts 41 by the biasing forces of the coil springs 73, are pushed by the board frame 25 and the pushing projection 271*d* so as to be inserted into the positioning holes 60. Instead of this, it is also possible to adopt a composition in which, when installing the developer apparatus 122 on the image forming frame 30, the rising movement prevention pins 72 are made to project towards the positioning holes 60 against the biasing forces of the springs by means of interference with a predetermined interference member on the image forming frame 30.

(4) In the first and second embodiments, an example is described in which the front ends of pin main bodies 721 are inserted into positioning holes 60 provided in a recessed manner in the end faces of rocking fulcrum shafts 41, in order to prevent the rocking fulcrum shafts 41 from rising up from the U-shaped grooves 421. Instead of this, it is also possible to press down the upper circumferential surfaces of the rocking fulcrum shafts 41. By adopting this modification, it becomes unnecessary to bore positioning holes 60, one by one, in the end faces of the rocking fulcrum shafts 41, thus making a corresponding contribution to reducing manufacturing costs.

(5) In the embodiments described above, a composition was described in which the posture is changed between a developing posture and a non-developing posture. However, it is not especially necessary to change posture, and the posture can also be set to a developing posture when the developer apparatus 122 is in an installed state on the image forming frame 30.

The concrete embodiments described above principally comprise inventions having the compositions described below.

The image forming apparatus relating to one aspect of the present invention is an image forming apparatus comprising: an image bearing body; a developer apparatus which has a mutually opposing first side face and second side face, and supplies a developer to the image bearing body; a frame which has a first wall surface opposing the first side face and a second wall surface opposing the second side face, and on which the developer apparatus is removably installed; a first fulcrum section and a second fulcrum section provided so as to project respectively on the first side face and the second side face; a first installation groove and a second installation groove which are provided respectively on the first wall surface and the second wall surface, the upper ends of which are open and into which the first fulcrum section and the second fulcrum section are respectively fitted; and a first supporting structure section and a second supporting structure section which support the first fulcrum section and the second fulcrum section that are fitted respectively into the first installation groove and the second installation groove.

According to this composition, by installing the developer apparatus from above in between the first and second wall surfaces of the frame, the first and second fulcrum sections are respectively fitted into the first and second installation grooves. By this means, the developer apparatus is supported on the frame by the first and second fulcrum sections. In this state, the first and second supporting structure sections prevent rising movement of the first and second fulcrum sections, and therefore the developer apparatus does not rise up due to the effects of the driving of the agitating member, or the like, inside the developer apparatus. Consequently, problems such as the occurrence of an incorrect developing process as a result of rising up of the developer apparatus are prevented, and therefore the image forming apparatus is able to carry out a correct image forming process at all times.

Desirably, the composition described above further comprises: an apparatus main body in which the image bearing body, the developer apparatus and the frame are accommodated; and a drawer mechanism which enables the frame to be pulled out in a horizontal direction from the apparatus main body. According to this composition, it is possible to simplify the installation and removal of the developer apparatus to and from the apparatus main body.

In this case, it is possible to adopt a composition wherein the first supporting structure section and the second supporting structure section assume a state of not supporting the first fulcrum section and the second fulcrum section, when the frame on which the developer apparatus is installed is pulled out from the apparatus main body, and move to a state of supporting the first fulcrum section and the second fulcrum section, in linkage with an operation of accommodating the frame in the apparatus main body. According to this composition, it is possible to achieve a state where the first fulcrum section and the second fulcrum section are supported by the first supporting structure section and the second supporting structure section, simply by accommodating the frame on which the developer apparatus is installed, in the apparatus main body, and therefore operability can be improved.

In the composition described above, desirably, the first fulcrum section and the second fulcrum section are disposed coaxially. According to this composition, it is possible to rotate the developer apparatus about the first and second fulcrum sections, and hence the functionality of the developer apparatus can be improved.

In this case, desirably, the composition further comprises: a rotating body having a rotating shaft, and disposed inside the developer apparatus; and the first fulcrum section, the second fulcrum section and the rotating shaft are disposed coaxially. According to this composition, it is possible to prevent the occurrence of the problem of rocking of the developer apparatus about the first and second fulcrum sections due to disruption of the balance of forces for transmitting drive power when the rotating body starts to rotate.

Furthermore, desirably, the composition further comprises: a developing roller which is disposed inside the developer apparatus, and supplies a developer to the image bearing body; and a rotating apparatus which rotates the developer apparatus about the first fulcrum section and the second fulcrum section and thereby changes the posture of the developer apparatus between a first state where transfer of developer is possible between the developing roller and the image bearing body, and a second state where transfer of developer therebetween is not possible. According to this composition, it is possible to achieve a composition which presses the developing roller against the image bearing body.

Desirably, in the composition described above, the first supporting structure section comprises: a positioning hole provided in a recessed manner in the end face of the first fulcrum section; and a pin which is provided in the first wall surface, and fits into the positioning hole. According to this composition, rising up of the developer apparatus is prevented by means of the pin being inserted into the positioning hole.

In this case, desirably, the positioning hole has a flat-shaped bottom surface portion. According to this composition, by forming a flat-shaped bottom surface portion, the positioning hole inevitably becomes a circular arc-shaped hole in cross-sectional view. As a result of this, the cross-sectional area of the positioning hole can be made greater than the cross-sectional area of the pin, while reliably guaranteeing the correctly positioned state of the pin, and therefore the operation of inserting the pin into the positioning hole becomes easy. In addition, the pin interferes with the bottom surface portion of the positioning hole and therefore rising up of the developer apparatus is provided in a reliable fashion.

Furthermore, desirably, the composition described above further comprises: a lever which changes the posture of the pin between a first posture of being fitted into the positioning hole and a second posture of being removed from the positioning hole. According to this composition, when an operator operates the lever in a state where the developer apparatus is installed in the frame, then the pin is fitted into the positioning hole of the fulcrum section and rising up of the developer apparatus is thereby prevented.

Desirably, the composition described above further comprises: an biasing member which impels the pin in a direction away from the positioning hole; and a pushing member which causes the pin to fit into the positioning hole against the biasing force of the biasing member. According to this composition, the pin is not able to interfere with the developer apparatus during the operation of installing the developer apparatus on the operating frame, and therefore the operation of installing the developer apparatus becomes easy. Furthermore, a measure for preventing rising up of the developer apparatus can be achieved by pushing the pin by means of the pushing member.

Desirably, in the composition described above, the first supporting structure section comprises: a first positioning hole provided in a recessed manner in the end face of the first fulcrum section; and a first pin which is provided in the first wall surface, and fits into the first positioning hole; and the second supporting structure section comprises: a second positioning hole provided in a recessed manner in the end face of the second fulcrum section; and a second pin which is provided in the second wall surface, and fits into the second positioning hole. According to this composition, it is possible to prevent rising movement, by means of the pins, on both side walls of the developer apparatus.

Desirably, the composition described above comprises: an apparatus main body in which the image bearing body, the developer apparatus and the frame are accommodated; a rotating body having a rotating shaft, and disposed inside the developer apparatus; a drive shaft which is disposed on the apparatus main body side, and generates a drive force that rotates the rotating body; and a drive joint section which couples the drive shaft and the rotating shaft and transmits the drive force to the rotating body; wherein the first fulcrum section is a tubular section provided about the perimeter of the drive joint section; and the drive joint section performs the function of the first supporting structure section. According to this composition, it is possible to achieve a structure which suppresses rising up of the developer apparatus by utilizing the drive joint section between the developer apparatus and the apparatus main body.

In this case, desirably, the drive joint section is a straight coupling type of joint, and comprises a first joint piece attached to the rotating shaft, and a second joint piece which is attached to the drive shaft and engages with the first joint piece; and a positioning shaft is provided so as to project on the second joint piece, and an insertion hole into which the positioning shaft is inserted is provided in the first joint piece. According to this composition, as well as being able to suppress rising up of the developer apparatus by utilizing the drive joint section, it is also possible to achieve highly accurate positioning of the developer apparatus by means of the positioning shaft and the insertion hole.

Furthermore, it is also possible to adopt a composition in which the second supporting structure section comprises: a positioning hole provided in a recessed manner in the end face of the second fulcrum section; and a pin which is provided in the second wall surface, and fits into the positioning hole. According to this composition, it is possible to suppress rising up of the developer apparatus by utilizing the drive joint on the one hand and using the pin on the other hand.

In the composition described above, desirably, the drive joint section is disposed in a position on the central axis of the developer apparatus in the direction of the first side face and the second side face, or a position directly below the central axis. According to this composition, it is possible to reduce relatively the pressing force of the developing roller pressing on the image bearing body due to the rotation of the developer apparatus about the first and second fulcrum sections.

This application is based on Japanese Patent Application Serial No. 2008-143491, filed in Japan Patent Office on May 30, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an image bearing body;

a developer apparatus which has a mutually opposing first side face and second side face, a developing roller disposed inside the developer apparatus and supplying a developer to the image bearing body;

a frame which has a first wall surface opposing the first side face and a second wall surface opposing the second side face, and on which the developer apparatus is removably installed;

a first fulcrum section and a second fulcrum section provided so as to project respectively on the first side face and the second side face, the first fulcrum section and the second fulcrum section being disposed coaxially;

a first installation groove and a second installation groove which are provided respectively on the first wall surface and the second wall surface, the upper ends of which are open and into which the first fulcrum section and the second fulcrum section are respectively fitted;

a first supporting structure section and a second supporting structure section which support the first fulcrum section and the second fulcrum section that are fitted respectively into the first installation groove and the second installation groove; and a pivoting apparatus which pivots the developer apparatus about the first fulcrum section and the second fulcrum section and thereby changes the posture of the developer apparatus between a first state where transfer of developer is possible between the developing roller and the image bearing body, and a second state where transfer of developer therebetween is not possible.

2. The image forming apparatus according to claim 1, further comprising:

an apparatus main body in which the image bearing body, the developer apparatus and the frame are accommodated; and a drawer mechanism which enables the frame to be pulled out in a horizontal direction from the apparatus main body.

3. The image forming apparatus according to claim 1, wherein the first supporting structure section comprises:

a first positioning hole provided in a recessed manner in the end face of the first fulcrum section; and a first pin which is provided in the first wall surface, and fits into the first positioning hole; and the second supporting structure section comprises:

a second positioning hole provided in a recessed manner in the end face of the second fulcrum section; and a second pin which is provided in the second wall surface, and fits into the second positioning hole.

4. An image forming apparatus, comprising:

an image bearing body;

a developer apparatus which has a mutually opposing first side face and second side face, and supplies a developer to the image bearing body;

a frame which has a first wall surface opposing the first side face and a second wall surface opposing the second side face, and on which the developer apparatus is removably installed;

a first fulcrum section and a second fulcrum section provided so as to project respectively on the first side face and the second side face;

a first installation groove and a second installation groove which are provided respectively on the first wall surface and the second wall surface, the upper ends of which are open and into which the first fulcrum section and the second fulcrum section are respectively fitted;

a first supporting structure section and a second supporting structure section which support the first fulcrum section and the second fulcrum section that are fitted respectively into the first installation groove and the second installation groove;

an apparatus main body in which the image bearing body, the developer apparatus and the frame are accommodated; and a drawer mechanism which enables the frame to be pulled out in a horizontal direction from the apparatus main body; wherein the first supporting structure section and the second supporting structure section:

assume a state of not supporting the first fulcrum section and the second fulcrum section, when the frame on which the developer apparatus is installed is pulled out from the apparatus main body; and move to a state of supporting the first fulcrum section and the second fulcrum section, in linkage with an operation of accommodating the frame in the apparatus main body.

5. An image forming apparatus, comprising:

an image bearing body;

a developer apparatus which has a mutually opposing first side face and second side face, and supplies a developer to the image bearing body;

a frame which has a first wall surface opposing the first side face and a second wall surface opposing the second side face, and on which the developer apparatus is removably installed;

a first fulcrum section and a second fulcrum section provided so as to project respectively on the first side face and the second side face;

a first installation groove and a second installation groove which are provided respectively on the first wall surface and the second wall surface, the upper ends of which are open and into which the first fulcrum section and the second fulcrum section are respectively fitted; and a first supporting structure section and a second supporting structure section which support the first fulcrum section and the second fulcrum section that are fitted respectively into the first installation groove and the second installation groove, the first supporting structure section comprising a positioning hole provided in a recessed manner in the end face of the first fulcrum section and a pin in the first wall surface and fit into the positioning hole.

6. The image forming apparatus according to claim 5, wherein the first fulcrum section and the second fulcrum section are disposed coaxially.

7. The image forming apparatus according to claim 6, further comprising:

a rotating body having a rotating shaft, and disposed inside the developer apparatus;

wherein the first fulcrum section, the second fulcrum section and the rotating shaft are disposed coaxially.

8. The image forming apparatus according to claim 6, further comprising:

a developing roller which is disposed inside the developer apparatus, and supplies a developer to the image bearing body; and a pivoting apparatus which pivots the developer apparatus about the first fulcrum section and the second fulcrum section and thereby changes the posture of the developer apparatus between a first state where transfer of developer is possible between the developing roller and the image bearing body, and a second state where transfer of developer therebetween is not possible.

9. The image forming apparatus according to claim 5, wherein the positioning hole has a flat-shaped bottom surface portion.

10. The image forming apparatus according to claim 5, further comprising: a lever which changes the posture of the pin between a first posture of being fitted into the positioning hole and a second posture of being removed from the positioning hole.

11. The image forming apparatus according to claim 5, further comprising:

an biasing member which impels the pin in a direction away from the positioning hole; and a pushing member which causes the pin to fit into the positioning hole against the biasing force of the biasing member.

12. An image forming apparatus, comprising:

an image bearing body;

a developer apparatus which has a mutually opposing first side face and second side face, and supplies a developer to the image bearing body, a rotating body having a rotating shaft, and disposed inside the developer apparatus;

a frame which has a first wall surface opposing the first side face and a second wall surface opposing the second side face, and on which the developer apparatus is removably installed;

a first fulcrum section and a second fulcrum section provided so as to project respectively on the first side face and the second side face;

a first installation groove and a second installation groove which are provided respectively on the first wall surface and the second wall surface, the upper ends of which are open and into which the first fulcrum section and the second fulcrum section are respectively fitted; and a first supporting structure section and a second supporting structure section which support the first fulcrum section and the second fulcrum section that are fitted respectively into the first installation groove and the second installation groove, an apparatus main body in which the image bearing body, the developer apparatus and the frame are accommodated;

a rotating body having a rotating shaft, and disposed inside the developer apparatus;

a drive shaft disposed on the apparatus main body side, and transmitting a drive force that rotates the rotating body; and a drive joint section coupling the drive shaft and the rotating shaft and transmitting the drive force to the rotating body;

wherein the first fulcrum section is a tubular section provided about the perimeter of the drive joint section; and the drive joint section performs the function of the first supporting structure section.

13. The image forming apparatus according to claim 12, wherein the drive joint section is a straight coupling type of joint, and comprises a first joint piece attached to the rotating shaft, and a second joint piece which is attached to the drive shaft and engages with the first joint piece; and a positioning shaft is provided so as to project on the second joint piece, and an insertion hole into which the positioning shaft is inserted is provided in the first joint piece.

14. The image forming apparatus according to claim 12, wherein the second supporting structure section comprises:

a positioning hole provided in a recessed manner in the end face of the second fulcrum section; and a pin which is provided in the second wall surface, and fits into the positioning hole.

15. The image forming apparatus according to claim 14, wherein the first fulcrum section and the second fulcrum section are disposed coaxially.

16. The image forming apparatus according to claim 15, wherein the drive joint section is disposed in a position on the central axis of the developer apparatus in the direction of the first side face and the second side face, or a position directly below the central axis.

* * * * *